US010486874B2

(12) United States Patent
Jego

(10) Patent No.: US 10,486,874 B2
(45) Date of Patent: Nov. 26, 2019

(54) HOLDING SYSTEM FOR A ROW OF INDIVIDUAL POTS, BLANKS KIT AND PACKAGING OF INDIVIDUAL POTS

(71) Applicant: SYNERLINK, Puiseux Pontoise (FR)

(72) Inventor: Fabien Jego, Saint Andre les Vergers (FR)

(73) Assignee: SYNERLINK, Puiseux Pontoise (FR)

( * ) Notice: Subject to any disclaimer, the term of this patent is extended or adjusted under 35 U.S.C. 154(b) by 128 days.

(21) Appl. No.: 15/334,478

(22) Filed: Oct. 26, 2016

(65) Prior Publication Data

US 2018/0111734 A1 Apr. 26, 2018

(51) Int. Cl.

| | |
|---|---|
| ***B65D 71/00*** | (2006.01) |
| ***B65D 71/40*** | (2006.01) |
| ***B65D 71/42*** | (2006.01) |
| ***B65D 5/00*** | (2006.01) |
| ***B65D 5/42*** | (2006.01) |
| ***B65D 5/468*** | (2006.01) |
| ***B65B 17/02*** | (2006.01) |
| *B65D 71/46* | (2006.01) |
| *B65D 71/16* | (2006.01) |

(52) U.S. Cl.

CPC ..... *B65D 71/42* (2013.01); *B65B 17/025* (2013.01); *B65D 5/001* (2013.01); *B65D 5/4266* (2013.01); *B65D 5/4608* (2013.01); *B65D 71/403* (2013.01); *B65D 71/16* (2013.01); *B65D 71/46* (2013.01); *B65D 2571/00716* (2013.01)

(58) Field of Classification Search

CPC .... B65D 21/0201; B65D 71/42; B65D 71/16; B65D 71/403; B65D 2571/00716; B65D 2571/00277; B65D 2571/00172; B65D 67/02; B65D 5/001; B65D 5/4266; B65D 5/4608; B65D 71/46; B31D 5/0017; B65B 5/06; B65B 5/5405; B65B 17/025

USPC ..... 206/139, 148, 431, 434, 435, 485, 429, 206/577, 223, 216, 147, 153, 158, 161, 206/427; 294/34, 87.2, 87.22, 87.24, 294/87.26, 158, 159, 87.28; 220/3.4, 220/23.2, 23.83, 23.91, 62, 729, 786; 53/298, 443

See application file for complete search history.

(56) References Cited

U.S. PATENT DOCUMENTS 2,965,410 A * 12/1960 Hughes ..... B65D 71/42 206/153
3,005,654 A * 10/1961 Doran ..... B65D 71/42 206/149

(Continued)

*Primary Examiner* — Gideon R Weinerth
(74) *Attorney, Agent, or Firm* — Young & Thompson

(57) ABSTRACT

Holding system (2) for a row (3) of individual pots (4), intended to facilitate shelving of a row of individual pots that are aligned in a longitudinal direction (X), with the pots (4) being of the type that has a bottom wall (5), a side wall (6) that is closed on itself, and a collar (8) at one end (4*a*, 4*b*) of the pot. The system includes a pot-holding assembly (10), extending in a longitudinal direction (X), and including a large number of gripping surfaces (12) that can exert a support on the collars (8) of the pots (4) of a row of individual pots, a large number of gripping counter-surfaces (13) that can exert a counter-support on the pots (4) of the row of individual pots such that the pots are sandwiched and held between the gripping surfaces (12) and the gripping counter-surfaces (13) of the pot-holding assembly.

21 Claims, 8 Drawing Sheets

(56) References Cited

U.S. PATENT DOCUMENTS 3,311,402 A * 3/1967 Spandock ..... B65D 71/40 206/153
3,390,766 A * 7/1968 Stockdale ..... B65D 5/5038 206/427
3,414,313 A * 12/1968 Schwarz ..... B65D 71/48 206/156
3,527,345 A * 9/1970 Iorio ..... B65D 71/42 206/145
3,638,990 A * 2/1972 Huault ..... B65D 71/42 294/87.2
3,756,394 A * 9/1973 Huault ..... B65D 71/42 206/431
4,336,898 A * 6/1982 Joyce ..... B65D 71/46 206/148
4,603,809 A * 8/1986 Vilotte ..... B65D 85/32 206/427
4,671,453 A * 6/1987 Cassidy ..... B65D 65/24 206/147
4,938,356 A * 7/1990 Galiegue ..... B65D 71/42 206/158
5,188,226 A * 2/1993 Platt ..... B65D 71/42 206/152
5,355,999 A * 10/1994 Sutherland ..... B65D 71/42 206/147
5,601,186 A * 2/1997 Van Hine ..... B65D 71/40 206/141
5,611,431 A * 3/1997 Harris ..... B65D 71/16 206/153
5,855,275 A * 1/1999 Hunter ..... B65D 71/16 206/429
5,921,392 A * 7/1999 Davis ..... B65D 71/46 206/151
5,957,289 A * 9/1999 Negelen ..... B65D 71/20 206/140
6,223,892 B1 * 5/2001 Bakx ..... B65D 71/46 206/148
7,163,103 B2 * 1/2007 Bakx ..... B65D 71/20 206/151
7,721,878 B2 * 5/2010 Requena ..... B65D 71/46 206/147
7,766,181 B2 * 8/2010 Fogle ..... B65D 71/46 220/212
8,701,878 B2 * 4/2014 Spivey, Sr. ..... B65D 71/46 206/148
8,955,674 B2 * 2/2015 Spivey, Sr. ..... B65D 5/4266 206/148
2004/0079666 A1 * 4/2004 Bakx ..... B65D 71/46 206/427
2004/0206639 A1 * 10/2004 Karlsson ..... B65D 71/42 206/170
2005/0199513 A1 * 9/2005 Bakx ..... B65D 71/20 206/139
2008/0121536 A1 * 5/2008 Miret ..... B65D 71/46 206/148
2012/0138489 A1 * 6/2012 Holley, Jr. ..... B65D 71/42 206/153
2012/0199639 A1 * 8/2012 Given ..... B65D 5/5035 229/120.08
2012/0267426 A1 * 10/2012 Hendricks ..... B65D 71/16 229/185

* cited by examiner

HOLDING SYSTEM FOR A ROW OF INDIVIDUAL POTS, BLANKS KIT AND PACKAGING OF INDIVIDUAL POTS

BACKGROUND OF THE INVENTION

Field of the Invention

The invention relates to the field of packaging individual pots, in particular for facilitating shelving a row of individual pots.

The invention more specifically has as its object a holding system for a row of individual pots, which is intended to facilitate shelving a row of individual pots, a packaging of individual pots comprising such a pot-holding system, a flat blanks kit that is intended for forming such a holding system for a row of individual pots, a flat pot-holding blank, and a flat pot-unlocking blank for such a blanks kit, a method for producing such a packaging of individual pots, a method for releasing individual pots from such a packaging of individual pots, and a production line for such a packaging of individual pots.

Description of the Related Art

An individual pot, such as the one being considered, comprises a bottom wall, a side wall that is closed on itself, and a collar at one end of the pot. In a simple embodiment, the pot is in the shape of a cylinder or a truncated cone with a transverse collar toward its upper opening, a top closing such as a flat lid can be made integral with and on the collar. In other embodiments, the generatrix of the side wall is a line other than a straight line, having a more or less complex shape, and the guiding curve is other than a circle, being, for example, a curvilinear square with rounded corners.

In one embodiment, such a pot is made of heat-formed plastic material, and it has a certain hold that allows it to be self-supporting, but the pot can be made of other materials and by other methods.

Such a pot is typically intended to contain contents that may or may not be homogeneous, having an overall state that is more or less fluid, which does not exclude the presence of more or less solid pieces. Such contents are, for example, a milk product or a dessert, with this list not being limiting.

In one embodiment, the pot is intended to receive a dose of such contents for single use, for example on the order of about 100 grams and, in this case, it may have a height on the order of several centimeters and be inscribed laterally in a cylinder whose diameter is also on the order of several centimeters. In other embodiments, the pot that is intended for a mini-dose is smaller, or, in contrast, the pot that is intended for a larger dose is larger.

To shelve such individual pots, an operator picks up, for example, the individual pots in a shipping container and arranges and aligns them with one another on a shelf of a supermarket shelving system to form one or more row(s) of individual pots. Such an operation requires a certain period of time on the part of the operator, in particular because the former runs the risk of knocking over the pots if he carries out the shelving too quickly.

Alternatively, boxes called "ready-to-sell" or racks usually made of cardboard or plastic are known, which boxes are shipping containers that are suitable for being placed on shelves and seen by a consumer. Such boxes or racks receive pots arranged in several columns and several rows, with said pots being arranged on the bottom of a box and usually bounded laterally by low vertical flanges surrounding the bottom of the box and making it possible to prevent the pots from falling out of the box during shelving. These boxes or rack thus make it possible for an operator to shelve, in a simultaneous manner, a large quantity of pots, thus reducing the period of time and/or the number of operators necessary to this operation.

In practice, these boxes and racks cannot be used for placing on a shelf a single row of individual pots because the aspect ratio of the box in this case makes handling difficult. The individual pots are only held by the low flanges that delimit the bottom of the box, and they are not stabilized by the presence of other pots. The pots thus run the risk of falling out of the box during shelving.

Furthermore, it is known to hold a portion of the individual pots, for example a collar or a tapered foot of the pots, for facilitating the handling of individual pots, in particular when said pots are aligned in a longitudinal direction to form at least one row of individual pots. Thus, for example, the documents U.S. Pat. Nos. 2,331,038 and 2,752,080 disclose systems for holding a row of individual pots, with the pots being of the type that have a bottom wall, a side wall that is closed on itself, and a collar at one end of the pot. Such a system for holding a row of individual pots comprises a pot-holding assembly that extends in a longitudinal direction and that comprises:

- A large number of gripping surfaces that can exert a support on the collars of the pots of a row of individual pots,
- A large number of gripping counter-surfaces that can exert a counter-support on the pots of the row of individual pots in such a way that said pots are sandwiched and held between the gripping surfaces and the gripping counter-surfaces of the pot-holding blank.

Such an assembly can be placed on a shelf with the pots that are accessible to a consumer. The consumer who desires to take a pot from the row can then exert a force on the pot that is sufficient to disengage it from the pot-holding assembly.

However, such systems for holding a row of individual pots have drawbacks. Thus, it is not easy to calibrate the force to be overcome to disengage a pot from the pot-holding assembly in such a way that, on the one hand, the pots are held sufficiently by the pot-holding assembly to facilitate the shelving of the row of individual pots, and, on the other hand, the pots are loose enough in the pot-holding assembly that consumers of any age and physical strength can easily pick up the pots from the row of pots. Furthermore, such systems cannot be easily adapted to the case where the collars of the pots are placed at the upper end of the pots opposite to the surface of the supermarket shelf. In this case, actually, the holding system is inserted between the pot and the consumer, and, on the one hand, makes access to the pots difficult, and, on the other hand, complicates the shelving and the picking up of pots by imposing a stronger holding force on the pots.

BRIEF SUMMARY OF THE INVENTION

The problem on which the invention is based is thus to propose systems for holding a row of individual pots that facilitate the shelving of small quantities of individual pots, in particular from a row of individual pots, while making it possible to easily pick up the pots from the row of shelved individual pots subsequently. This problem arises in combination with that of a reduced cost of the pot-holding system and packaging of a row of individual pots, of high machinability for high rates, with a method for manufacturing pot-holding systems and packaging systems of a secure row of individual pots and a production line that precludes penalizing complexities.

Below, a disclosure of the invention as it is characterized.

For this purpose, the invention has as its first object a system for holding a row of individual pots, where said system is intended to facilitate shelving of a row of individual pots that are aligned in a longitudinal direction, with the pots being of the type that has a bottom wall, a side wall that is closed on itself, and a collar at one end (4*a*, 4*b*) of the pot, with the system comprising a pot-holding assembly, extending in a longitudinal direction and comprising A large number of gripping surfaces that can exert a support on the collars of the pots of a row of individual pots, A large number of gripping counter-surfaces that can exert a counter-support on the pots of the row of individual pots in such a way that said pots are sandwiched and held between the gripping surfaces and the gripping counter-surfaces of the pot-holding assembly.

The system also comprises a pot-unlocking assembly that can be moved in relation to the pot-holding assembly between A pot-holding position: the pot-unlocking assembly leaves a large number of gripping surfaces and a large number of gripping counter-surfaces free to sandwich and to hold the pots of the row of individual pots, and An unlocking position: the pot-unlocking assembly detaches from the pots at least one among a large number of gripping surfaces and a large number of gripping counter-surfaces, in such a way as to release the pots from the row of individual pots of the pot-holding assembly.

In preferred embodiments of the invention, it is optionally possible to adopt additionally one and/or the other of the following arrangements:

The pot-holding assembly comprises a pot-holding blank, in particular is formed by a single blank made of cardboard or the like, in particular corrugated cardboard;

The pot-holding blank has, perpendicularly to the longitudinal direction, a U-shaped cross-section that is suitable for surrounding one end of each pot of the row of individual pots, with the pot-holding blank comprising a base and two side wings on either side of the base inclined in relation to said base, in particular essentially perpendicular to said base;

The gripping surfaces are formed in the side wings of the pot-holding blank and the gripping counter-surfaces are formed in the base of the pot-holding blank;

The side wings of the pot-holding blank comprise a large number of centering lunules that are suitable for being penetrated by portions of the collars of the pots of the row of individual pots, and the gripping surfaces are formed on gripping tabs of the pot-holding blank that extends among the centering lunules, in particular by end edges of said gripping tabs;

When the pot-unlocking assembly is in the pot-holding position, the gripping surfaces of the pot-holding assembly are able to be in close contact with the collars of the pots; in particular, the gripping surfaces of the pot-holding blank are able to be in close contact with surfaces of the collars of the pots that are opposite to the end of each pot of the row of individual pots that is surrounded by the U-shaped cross-section of the pot-holding blank, in particular lower surfaces of collars of the pots if an upper end of each pot of the row of individual pots is surrounded by the U-shaped cross-section of the pot-holding blank or upper surfaces of the collars of the pots if a lower end of each pot of the row of individual pots is surrounded by the U-shaped cross-section of the pot-holding blank;

When the pot-unlocking assembly is in the pot-holding position, the gripping counter-surfaces of the pot-holding assembly are able to exert a counter-support on the end of each pot of the row of individual pots that is surrounded by the U-shaped cross-section of the pot-holding blank;

The pot-unlocking assembly comprises a large number of unlocking surfaces respectively associated with the gripping surfaces, with the unlocking surfaces being suitable for being inserted between the collars of the pots and the gripping surfaces when the pot-unlocking assembly is in the unlocking position, in such a way as to release the pots from the row of individual pots of the pot-holding assembly;

The pot-unlocking assembly comprises a pot-unlocking blank, in particular is formed by a single blank made of cardboard or the like, in particular corrugated cardboard;

The pot-unlocking blank has, perpendicularly to the longitudinal direction, a U-shaped cross-section that is suitable for surrounding one end of each pot of the row of individual pots, with the pot-unlocking blank comprising a base and two side wings on either side of the base that are inclined in relation to said base, in particular essentially perpendicular to said base;

The base of the pot-unlocking blank is suitable for coming into contact with the end of each pot of the row of individual pots that is surrounded by the pot-unlocking blank, with the unlocking surfaces being formed in the side wings of the pot-unlocking blank;

The pot-unlocking blank is suitable for being sandwiched between the pot-holding blank and the pots of the row of individual pots;

When the pot-unlocking assembly is in the pot-holding position, the gripping counter-surfaces of the pot-holding assembly are able to exert a counter-support on the end of each pot of the row of individual pots that is surrounded by the U-shaped cross-section of the pot-holding blank by means of the base of the pot-unlocking blank, in particular when the pot-unlocking assembly is in the pot-holding position, the gripping counter-surfaces of the pot-holding assembly are in contact with the base of the pot-unlocking blank, and said base of the pot-unlocking blank is able to be in contact with the end of each pot of the row of individual pots;

the side wings of the pot-unlocking blank comprise a large number of openings that are suitable for being penetrated by portions of the collars of the pots of the row of individual pots, and the unlocking surfaces are formed on the unlocking tabs of the pot-unlocking blank that extends within openings of the pot-unlocking blank, in particular by extension surfaces of said tabs that are directed toward the outside of the U-shaped cross-section of the pot-unlocking blank;

When the pot-unlocking blank is in the pot-holding position, the unlocking tabs of the pot-unlocking blank extend through the centering lunules of the pot-holding blank, close to the gripping tabs of the pot-holding blank, and, when the pot-unlocking blank is in the unlocking position, the unlocking tabs are able to be inserted between the gripping tabs and the collars of the pots of the row of individual pots;

Each unlocking tab comprises a side leading edge that extends beyond a side edge opposite the gripping tab associated with the unlocking tab;

When the pot-unlocking assembly is in the pot-holding position, the unlocking tabs of the pot-unlocking blank are arranged at least in part between leading edges of the collars of the pots and the gripping tabs;

The pot-unlocking blank is suitable for moving in relation to the pot-holding blank between the holding position and the unlocking position by sliding in the longitudinal direction;

A side leading edge of an unlocking tab is inclined in relation to a vertical direction that is perpendicular to the longitudinal direction of movement of the pot-unlocking blank, in such a way that said unlocking tab is able to be inserted gradually between the gripping tab and the collars of the pots of the row of individual pots when the pot-unlocking assembly is moved from the pot-holding position to the unlocking position;

The pot-unlocking blank comprises at least one stopping tab that extends from the base of the pot-unlocking blank, through at least one opening of the pot-unlocking blank and through at least one centering lunule of the pot-holding blank, said at least one stopping tab being suitable for abutting against an edge of at least one centering lunule of the pot-holding blank in such a way as to limit movement of the pot-unlocking assembly in relation to the pot-holding assembly between the holding position and the unlocking position;

One from among the pot-holding assembly and the pot-unlocking assembly comprises a traction tab that is suitable for making it possible to slide the pot-holding assembly and the pot-unlocking assembly in relation to one another in such a way as to move the pot-unlocking assembly between the holding position and the unlocking position; in particular the pot-unlocking blank has said traction tab;

The traction tab has a central opening that can provide access to the collars of pots of the row of individual pots that are sandwiched and held between the gripping surfaces and the gripping counter-surfaces of the pot-holding assembly, in such a way as to allow a manual holding of pots by an operator moving the pot-unlocking assembly in relation to the pot-holding assembly from the holding position to the unlocking position.

The invention also has as its object a packaging of a row of individual pots comprising a pot-holding system as presented in detail above and a row of individual pots, with the pots being of the type that has a bottom wall, a side wall that is closed on itself, and a collar at one end of the pot, with the pots being aligned in a longitudinal direction to form the row of individual pots.

In preferred embodiments of the invention, it is optionally possible to adopt additionally one and/or the other of the following arrangements:

The pot-unlocking assembly is in the pot-holding position, and the pots are sandwiched and held between the gripping surfaces and the gripping counter-surfaces of the pot-holding assembly;

The pot-unlocking assembly is in the pot-unlocking position, and the pots are released from the pot-holding assembly.

The invention also has as its object a flat blanks kit, where said kit is intended for the forming of a system for holding a row of individual pots as presented in detail above, with the kit comprising:

A flat pot-holding blank, which is generally rectangular in shape, made of cardboard or the like, extending essentially in a longitudinal direction and comprising a base panel that is respectively surrounded on either side, in a transverse direction that is perpendicular to the longitudinal direction, by two respective side wing panels, With the base panel being separated from the side wing panels by grooved or cut-out lines, capable of and intended for the folding of side wing panels in relation to the base panel in such a way as to form a pot-holding blank in volume that has a U-shaped cross-section that is perpendicular to the longitudinal direction, With the side wing panels of the pot-holding blank comprising a large number of centering lunules and a large number of gripping tabs extending within the centering lunules, and A flat pot-unlocking blank, which is generally rectangular in shape, made of cardboard or the like, extending essentially in a longitudinal direction and comprising a base panel that is respectively surrounded on either side, in a transverse direction perpendicular to the longitudinal direction, by two respective side wing panels, With the base panel being separated from the side wing panels by grooved or cut-out lines, capable of and intended for the folding of side wing panels in relation to the base panel in such a way as to form a pot-unlocking blank in volume that has a U-shaped cross-section that is perpendicular to the longitudinal direction, With the side wing panels of the pot-unlocking blank comprising a large number of openings and a large number of unlocking tabs that extend within the openings.

In preferred embodiments of the invention, it is optionally possible to adopt additionally one and/or the other of the following arrangements:

The gripping tabs of the pot-holding blank extend within centering lunules of the pot-holding blank from the side wings of the pot-holding blank and in the direction of the base of the pot-holding blank in the transverse direction;

The unlocking tabs of the pot-unlocking blank extend within openings of the pot-unlocking blank from the side wings of the pot-unlocking blank and in the direction of the base of the pot-unlocking blank in the transverse direction;

The grooved lines separating the base panel from the side wing panels of the flat pot-holding blank and the grooved lines separating the base panel from the side wing panels of the flat pot-unlocking blank extend in the longitudinal direction;

The unlocking tabs of the flat pot-unlocking blank are at least in part defined by cut-out lines that penetrate into the base panel of the pot-unlocking blank, in such a way that when the pot-unlocking blank is formed by volume and has a U-shaped cross-section that is perpendicular to the longitudinal direction, the unlocking tabs extend, in the openings of the pot-unlocking blank, beyond the base of the pot-unlocking blank;

The flat pot-unlocking blank comprises at least one stopping tab that extends from the base panel of the pot-unlocking blank through at least one opening of the pot-unlocking blank.

The invention also has as its object a flat pot-holding blank, which is generally rectangular in shape, made of cardboard or the like, especially intended to be integrated into a flat blanks kit as presented in detail above, with the pot-holding blank extending essentially in a longitudinal direction and comprising a base panel that is respectively surrounded on either side, in a transverse direction that is perpendicular to the longitudinal direction, by two respective side wing panels, With the base panel being separated from the side wing panels by grooved or cut-out lines, capable of and intended for the folding of side wing panels in relation to the base panel in such a way as to form a pot-holding blank in volume that has a U-shaped cross-section that is perpendicular to the longitudinal direction, With the side wing panels of the pot-holding blank comprising a large number of centering lunules and a large number of gripping tabs extending within the centering lunules.

The invention also has as its object a flat pot-unlocking blank, with a generally rectangular shape, made of cardboard or the like, especially intended to be integrated into a flat blanks kit as presented in detail above, with the pot-unlocking blank extending essentially in a longitudinal direction and comprising a base panel that is respectively surrounded on either side, in a transverse direction that is perpendicular to the longitudinal direction, by two respective side wing panels, With the base panel being separated from the side wing panels by grooved or cut-out lines, capable of and intended for the folding of side wing panels in relation to the base panel in such a way as to form a pot-unlocking blank in volume that has a U-shaped cross-section that is perpendicular to the longitudinal direction, With the side wing panels of the pot-unlocking blank comprising a large number of openings and a large number of unlocking tabs that extend within the openings.

The invention also has as its object a method for the production of a packaging of a row of individual pots as presented in detail above, in which:

A flat blanks kit as presented in detail above is available,

Individual pots, with the pots being of the type having a bottom wall, a side wall that is closed on itself, and a collar at one end of the pot, are available, The individual pots are aligned in a longitudinal direction X) for forming a row of individual pots, and the individual pots, the flat pot-unlocking blank, and the flat pot-holding blank are stacked in such a way that the pot-unlocking blank is sandwiched between the flat pot-holding blank and the individual pots, and The side wing panels of the flat-pot-holding blank are folded in relation to the base panel of the flat pot-holding blank around grooved lines, and the side wing panels of the flat pot-unlocking blank are folded in relation to the base panel of the flat pot-unlocking blank around grooved lines, in such a way as to form a pot-holding blank in volume and a pot-unlocking blank in volume that each have, perpendicularly to the longitudinal direction, a U-shaped cross-section surrounding one end of each pot of the row of individual pots, with the pots being sandwiched and held between the gripping surfaces and the gripping counter-surfaces of the pot-holding blank in volume.

In preferred embodiments of the invention, it is optionally possible to adopt additionally one and/or the other of the following arrangements:

The individual pots are aligned in the longitudinal direction for forming a row of individual pots, and then the flat pot-unlocking blank and the flat pot-holding blank are arranged and stacked on ends of the pots of the row of pots having the collars in such a way that the pot-unlocking blank is sandwiched between the flat pot-holding blank and the individual pots;

The flat pot-holding blank and the flat pot-unlocking blank are stacked, and then the individual pots are arranged on the flat pot-unlocking blank and they are aligned in the longitudinal direction for forming a row of individual pots;

When the pots, the flat pot-holding blank, and the flat pot-unlocking blank are stacked, the individual pots, the flat pot-holding blank, and the flat pot-unlocking blank are aligned in the longitudinal direction in such a way that the collars of the pots are placed opposite the centering lunules of the flat pot-holding blank and openings of the flat pot-unlocking blank;

When the pots, the flat pot-holding blank, and the flat pot-unlocking blank are stacked, the flat pot-holding blank and the flat pot-unlocking blank are aligned in addition in the longitudinal direction in such a way that the collars of the pots are placed opposite gripping tabs of the flat pot-holding blank and offset in the longitudinal direction in relation to the unlocking tabs.

The invention also has as its object a method for relapsing individual pots from a packaging of a row of individual pots as presented in detail above, in which A packaging of a row of individual pots as presented in detail above in which the pot-unlocking assembly is in the pot-holding position and the pots are sandwiched and held between the gripping surfaces and the gripping counter-surfaces of the pot-holding assembly is available, The packaging is placed on a support, The pot-holding assembly and/or the pots is/are held, and a force is exerted on the unlocking assembly in such a way as to move the pot-unlocking assembly in relation to the pot-holding assembly from the holding position to the unlocking position.

In preferred embodiments of the invention, it is optionally possible to adopt additionally one and/or the other of the following arrangements:

The packaging is placed on a support in such a way that the pots of the row of individual pots rest on the support at one end of the pots opposite to the collar, and in addition, the holding system of the packaging is removed by allowing the pots of the row of individual pots to rest on the support;

The packaging is placed on a support in such a way that the pots of the row of individual pots rest on the support by means of the pot-holding system at one end of the pots that have the collar, and the holding system is left between the row of individual pots and the support, with the pot-unlocking assembly being in the unlocking position.

The invention also has as its object a production line for a packaging of a row of individual pots as presented in detail above, which comprises:

Means for making available flat blanks kits as presented in detail above, comprising flat pot-holding blanks and flat pot-unlocking blanks, Means for making available individual pots of the type having a base wall, a side wall that is closed on itself, and a collar at one end of the pot, Associated with means for making available flat blanks kits and with means for making available pots, conveying means that are capable of and intended for conveying the blanks (10, 11) of the flat blanks kits, the individual pots, the stacked pots and blanks, the packages of individual pots, with, ultimately, functional means comprising, from upstream to downstream:

Means for grasping, moving, and arranging individual pots and flat blanks (10, 11), capable of and intended for aligning individual pots in a longitudinal direction to form rows of individual pots, and to stack the individual pots, the flat pot-holding blanks, and the flat pot-unlocking blanks, in such a way that each pot-unlocking blank is sandwiched between a flat pot-holding blank and the individual pots of a row of individual pots, Folding means, capable of and intended for expanding in volume the pot-holding blanks and the pot-unlocking blanks for presenting, perpendicularly to the longitudinal direction, a U-shaped cross-section that surrounds one end of each pot of the row of individual pots, with the pots being sandwiched and held between the gripping surfaces and the gripping counter-surfaces of the pot-holding blank, by folding, around grooved lines (26, 27), side wing panels in relation to the base panel of the flat pot-holding blank and side wing panels in relation to the base panel of the flat pot-unlocking blank, And means for removing packages from rows of individual pots.

Compared to the prior art, the advantages of the invention are in particular that it is possible to easily and quickly shelve the individual pots and in particular a small quantity of individual pots such as a row of individual pots, and that it is then possible to release simultaneously all of the pots held by the holding system to make it possible to pick up shelved pots easily. The holding system can be removed to allow free access to the pots, for example when the collars of the pots are arranged at the upper end of the pots opposite to the surface of the supermarket shelf, or left in place if it does not prevent access to the pots, for example when the collars of the pots are arranged at the lower end of the pots close to the surface of the supermarket shelf, and said system is, for example, inserted between the surface of the shelf and the pots. In addition, this is achieved with a reduced cost of the pot-holding system and a packaging of a row of individual pots, a high machinability for high rates, in a reliable way with a production line that precludes penalizing complexities.

BRIEF DESCRIPTION OF THE DRAWINGS

The figures of the drawings are now briefly described.

DETAILED DESCRIPTION OF THE PREFERRED EMBODIMENTS

Below, a detailed disclosure of several assorted embodiments of the invention of examples and of reference to drawings.

Figure 1:
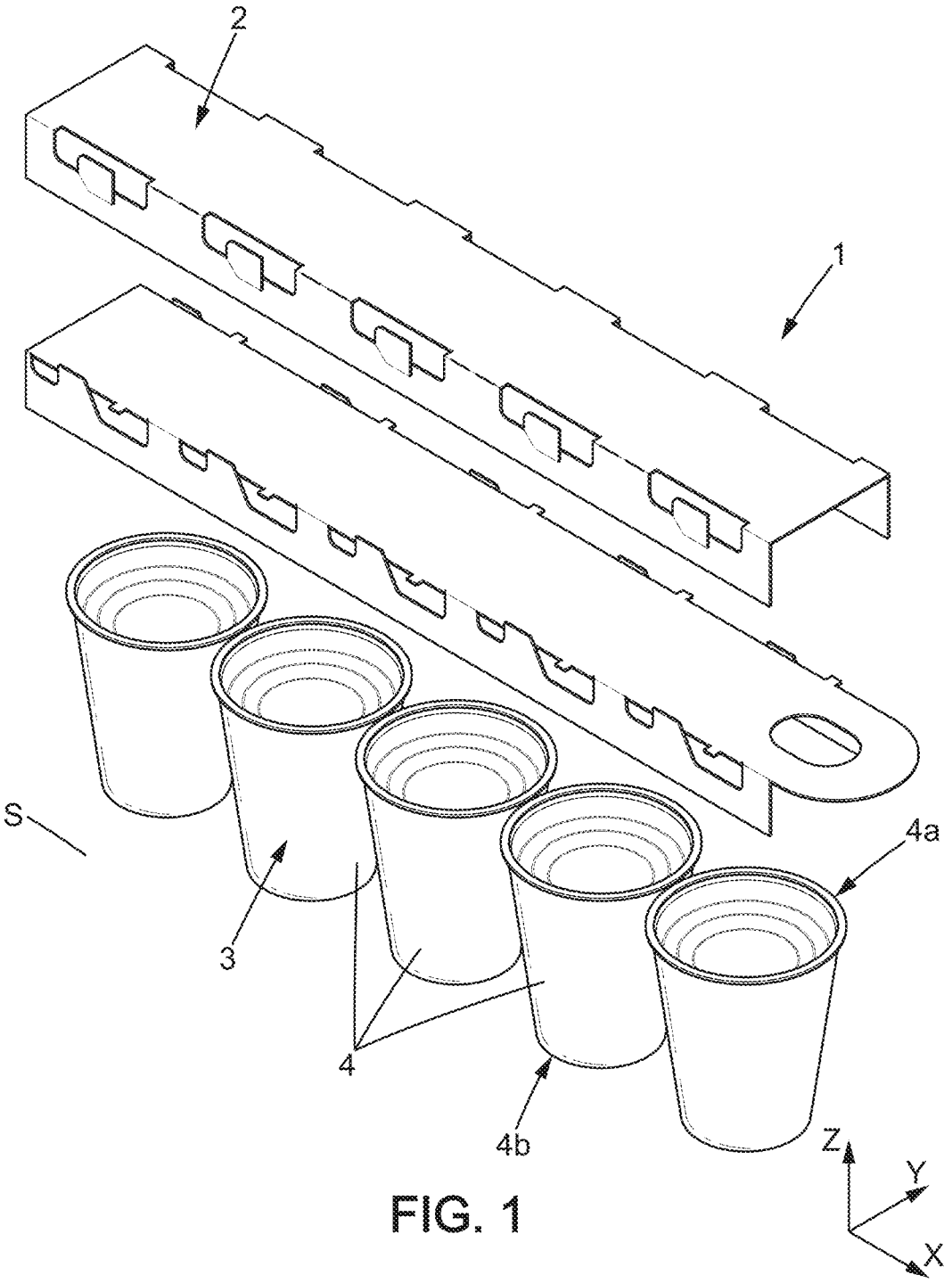
FIG. 1 is an exploded perspective view of a possible embodiment of a packaging of individual pots according to the invention, comprising a row of individual pots of five pots.

FIG. 1 illustrates a packaging 1 of a row of individual pots in accordance with the invention. Such a packaging 1 comprises a pot-holding system 2 and a row 3 of individual pots 4.

The individual pots 4 are of the type that has a bottom wall, a side wall that is closed on itself, and a collar at one end of the pot. The pots 4 are aligned in a longitudinal direction X for forming a row 3 of individual pots.

"Pot" is defined as a container as it was described in the introductory part and whose characteristics do not require being newly described here, being recalled that such a pot 4, which has a certain hold making it possible to be self-supporting, comprises a bottom wall 5, a side wall 6 that is closed on itself around a vertical direction Z with an opening 7 at an upper end 4*a* of the pot, and the bottom wall 5 at a lower end 4*b* of the pot, opposite, and a collar 8 that projects radially in relation to the vertical direction Z at one of the upper and lower ends of the pot. The pot can also comprise a top closure 9, such as, typically, a lid that is placed on and made integral with the opening 4*c*. Within the context of the invention, the pots 4 of a row 3 are similar, quite especially identical, and they are filled with certain contents, which may or may not be identical for the different pots 4, and closed.

"A row of individual pots" is defined as an assembly of pots that are juxtaposed with one another in the longitudinal direction and that comprise a single layer of pots in a vertical direction that is perpendicular to the longitudinal direction. "Individual pots" are defined as pots that are the pots that are separated from one another and are not connected to one another in particular by their collars 7.

The system 2 for holding a row of individual pots is illustrated in more detail in FIG. 2 and comprises a pot-holding assembly 10 and a pot-unlocking assembly 11. The pot-holding assembly 10 and the pot-unlocking assembly 11 extend in the longitudinal direction X and are stacked on one another.

The pot-holding assembly 10 can in particular comprise a pot-holding blank. In particular, the pot-holding assembly 10 can be formed by a single blank or multiple blanks made integral in such a way as to form an individual assembly. The pot-holding blank or blanks is/are, for example, made of cardboard or the like, in particular corrugated cardboard.

Likewise, the pot-unlocking assembly 11 can comprise a pot-unlocking blank. In particular, the pot-unlocking assembly 11 can be formed by a single blank or multiple blanks made integral in such a way as to form an individual assembly. The pot-unlocking blank or blanks are, for example, made of cardboard or the like, in particular corrugated cardboard.

"Cardboard" is defined as a layer material, such as the one commonly used or adapted to a blank having the destination indicated. Such cardboard can advantageously be of a relatively rigid type when it is folded in a U-shape to support the weight of a row of pots when it is grasped at one point, for example in the middle. The cardboard is thus, for example, corrugated cardboard, i.e., consisting of several sheets of ribbed paper glued together between flat paper sheets. The cardboard blanks can be folded at the location of grooved lines, provided for this purpose as is presented in detail later. "Cardboard or the like" is defined as materials other than cardboard, having characteristics of rigidity and hold as described above, which can also be used, for example injected or heat-formed plastic.

Figure 2A:
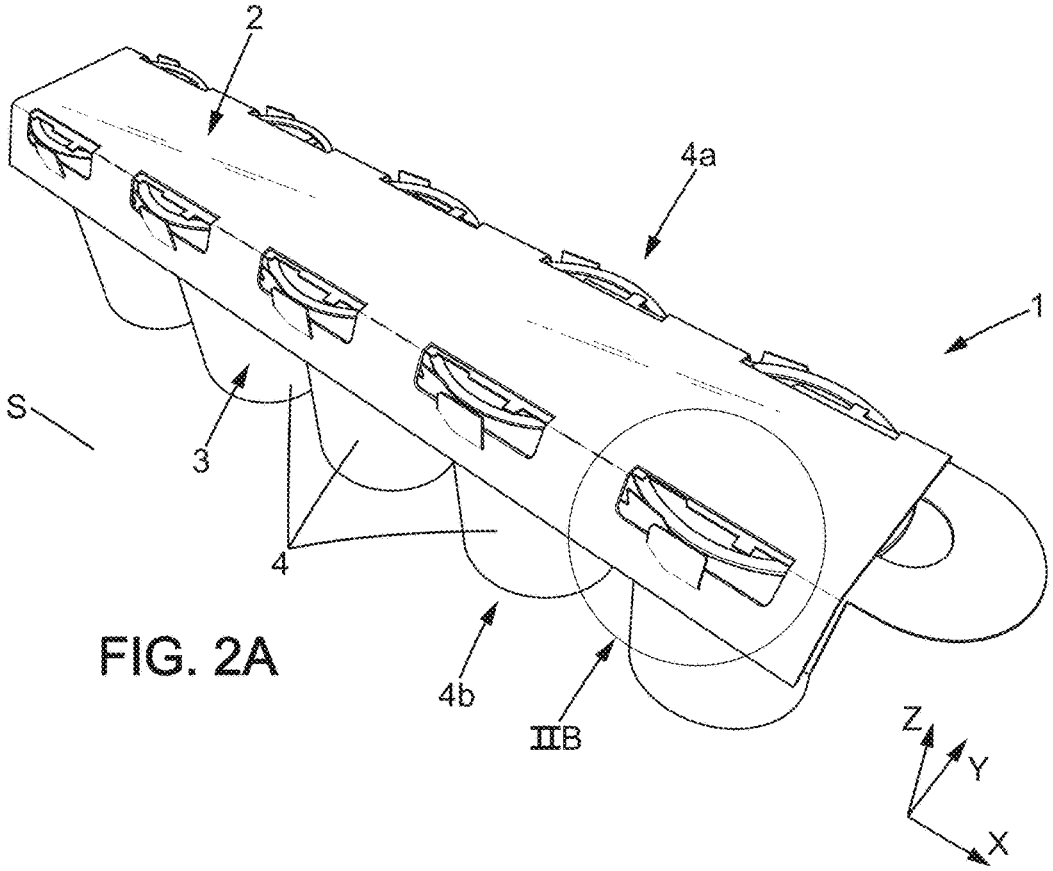
FIG. 2A is a top perspective view of the packaging of FIG. 1 and of the pot-holding system of said packaging, in which the pot-unlocking assembly is in the pot-holding position in relation to the pot-holding assembly, and the pots are sandwiched and held between the gripping surfaces and the gripping counter-surfaces of the pot-holding assembly.
Figure 2B:
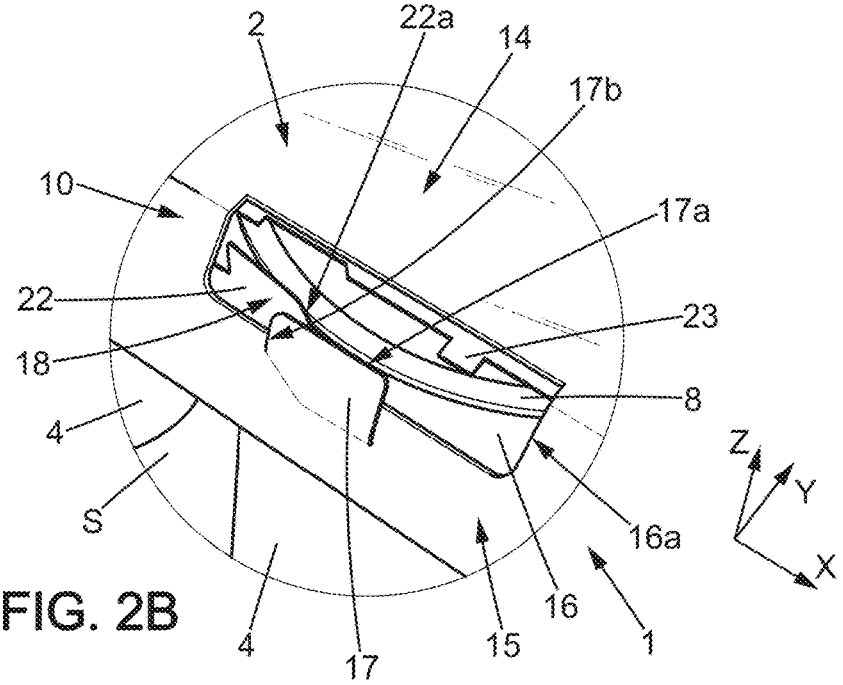
FIG. 2B is a perspective detail view of the packaging and of the pot-holding system of FIG. 2A that illustrates in particular the centering lunules and the gripping tabs of a pot-holding blank of a system in accordance with the invention, in which the pot-unlocking assembly is in the pot-holding position in relation to the pot-holding assembly.
Figure 2C:
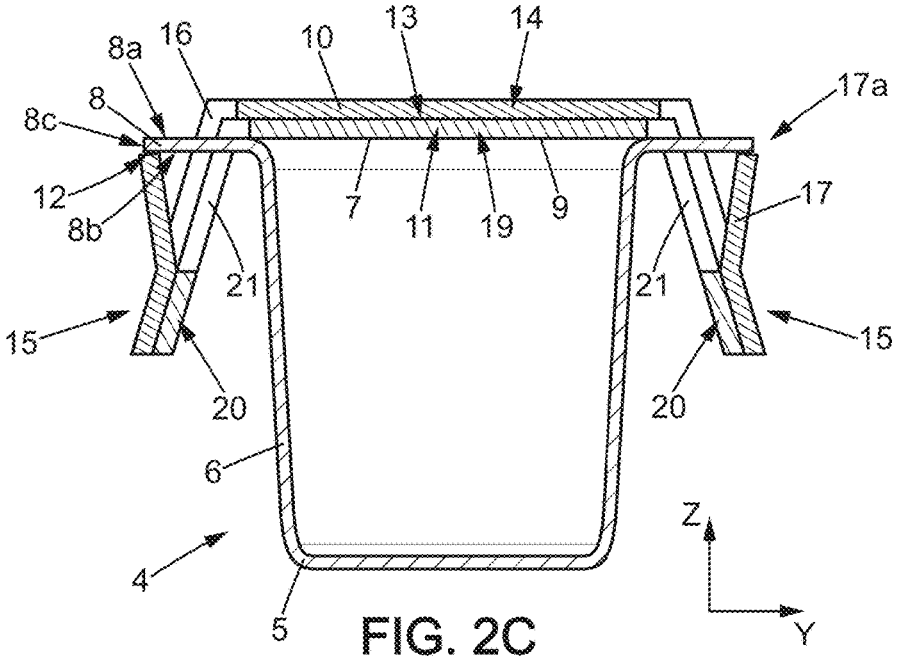
FIG. 2C is a cutaway view that is perpendicular to the longitudinal direction of the packaging of pots and of the pot-holding system of FIG. 2B, in which the pot-unlocking assembly is in the pot-holding position in relation to the pot-holding assembly.
Figure 3A:
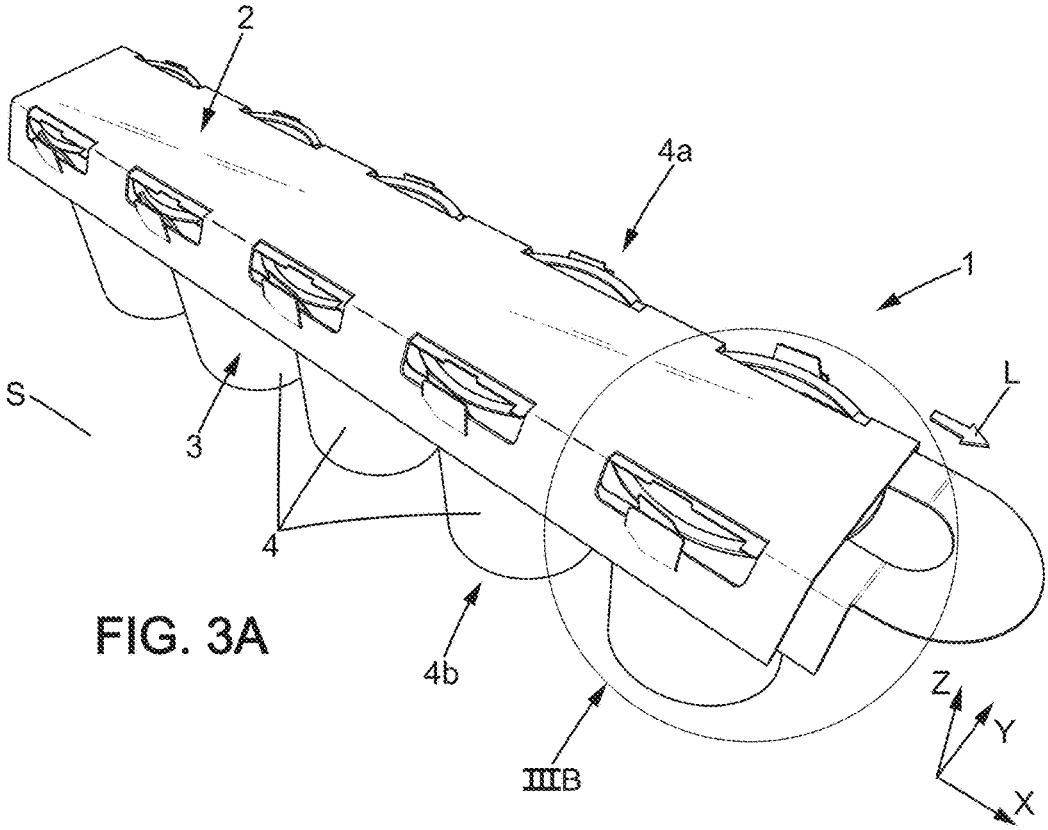
FIG. 3A is a top perspective view of the packaging of FIG. 1 and of the pot-holding system of said packaging, in which the pot-unlocking assembly is in the unlocking position in relation to the pot-holding assembly, and the pots are released from the pot-holding assembly.
Figure 3B:
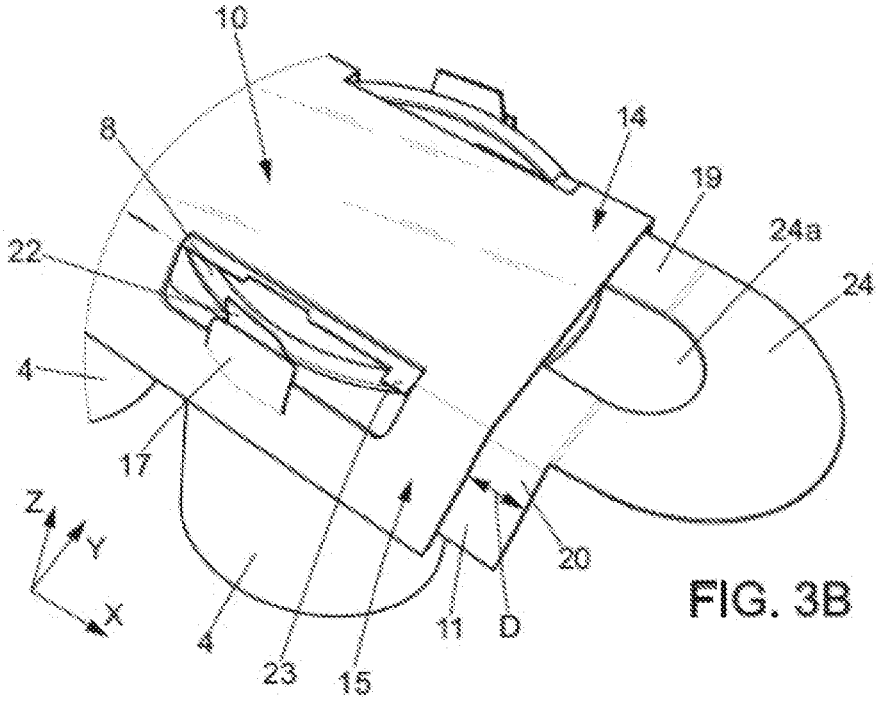
FIG. 3B is a perspective detail view of the packaging and of the pot-holding system of FIG. 3A that illustrates in particular the centering lunules, the gripping tabs, the openings and the unlocking tabs of a system in accordance with the invention, in which the pot-unlocking assembly is in the unlocking position in relation to the pot-holding assembly.
Figure 3C:
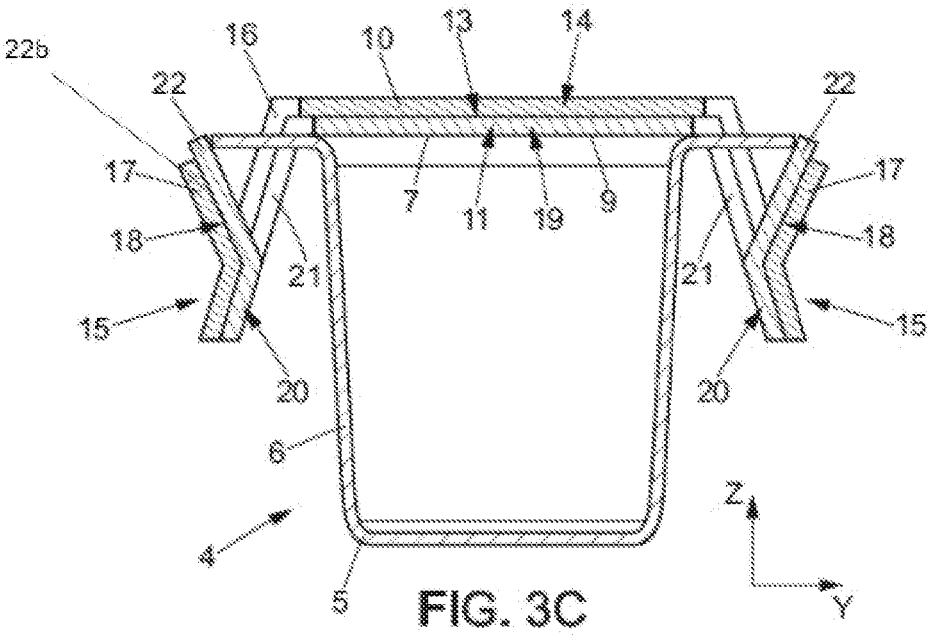
FIG. 3C is a cutaway view that is perpendicular to the longitudinal direction of the packaging of pots and the pot-holding system of FIG. 3B, in which the pot-unlocking assembly is in the unlocking position in relation to the pot-holding assembly.

The pot-unlocking assembly 11 can be moved in relation to the pot-holding assembly 10 between a pot-holding position that is illustrated in FIGS. 2A to 2C and an unlocking position that is illustrated in FIGS. 3A to 3C. For this purpose, the pot-unlocking assembly is suitable, for example, for sliding in relation to the pot-holding assembly in the longitudinal direction X between the holding position and the unlocking position in the general direction indicated by the arrow L of FIG. 3A.

Furthermore, the pot-holding assembly 10 comprises a large number of gripping surfaces 12 and a large number of gripping counter-surfaces 13.

Reference is made more particularly to the holding system 2 for a row of individual pots illustrated in FIG. 2B, in which the pot-unlocking assembly 11 is in the pot-holding position.

As can be seen in FIG. 2C, the gripping surfaces 12 exert a support on the collars 8 of the pots 4, and the gripping counter-surfaces 13 exert a counter-support on the pots 4, in particular on the ends of the pots 4 at the location of which the collars 8 of the pots 4 are present. The support exerted by the gripping surfaces 12 on the pots 4 and the counter-support exerted by the gripping counter-surfaces 13 on the pots 4 are such that the pots 4 are sandwiched and held between the gripping surfaces 12 and the gripping counter-surfaces 13, i.e., in particular sandwiched and held at their end 4*a* that has the collar 8.

The phrase "the pots are sandwiched and held between the gripping surfaces and the gripping counter-surfaces" is defined as that the gripping surfaces 12 and the gripping counter-surfaces 13 exert forces on the pots 4 of the row of pots such that respective components of said supports and counter-supports are in opposition and make it possible to hold the pots 4 between the gripping surfaces 12 and the gripping counter-surfaces 13. For this purpose, the gripping surfaces 12 and/or the gripping counter-surfaces 13 can in particular exert supports and counter-supports that are elastic on the pots 4.

Furthermore, the phrases "exert a support" and "exert a counter-support" are defined as applying a force directly, i.e., in close contact, or else by means of a part carrying out the transmission of force, for example by means of the pot-unlocking assembly 11, in particular the base 19 of the pot-unlocking blank 11, as is disclosed later.

The gripping surfaces 12 and the gripping counter-surfaces 13 can be essentially parallel to one another and opposite. The gripping surfaces 12 and the gripping counter-surfaces 13 can extend in a horizontal plane XY that is perpendicular to the vertical extension direction of the pots 4.

For this purpose, the pot-holding blank 10 of the pot-holding assembly 10 can be expanded in volume in such a way as to have, perpendicularly to the longitudinal direction, a U-shaped cross-section that is suitable for surrounding one end of each pot 4 of the row 3 of individual pots. The U-shaped cross-section of the pot-holding blank 10 can in particular surround the end of each pot 4 at or near the location from which the collar 8 extends.

Thus, the pot-holding blank 10 can comprise a base 14 and two side wings 15. The base 14 can extend in a horizontal plane XY, perpendicular to the vertical extension direction Z of the pots 4. The side wings 15 can be placed on either side of the base in a transverse direction Y of the horizontal plane XY, perpendicular to the longitudinal direction X. The side wings 15 can be inclined in relation to the base 14, in particular extend in the vertical direction Z and be essentially perpendicular to said base 14 as can be seen in FIG. 2C.

The phrase "the side wings can be essentially perpendicular to said base" is defined as that the side wings can have with the base an angle on the order of 90°, for example between 60 and 120°, around the longitudinal direction X. The angle between the side wings and said base can in particular be adapted to the shape of the pots and to the relative extension of the base 14 and collars 8 in the transverse direction Y.

The base 14 of the pot-holding blank 10 can have a general rectangular shape with an extension in the longitudinal direction X on the order of the length of the row 3 of pots 4 and an extension in the transverse direction Y, perpendicular to the longitudinal direction X, less than or equal to a space requirement of the pots 4 in said transverse direction Y. The base 14 of the pot-holding blank 10 can be in particular continuous and in a single piece.

The gripping surfaces 12 are then formed, for example, in the side wings 15 of the pot-holding blank 10, and the gripping counter-surfaces 13 are formed in the base 14 of the pot-holding blank 10.

FIG. 2B illustrate in more detail the side wings and the base of the pot-holding blank that can be seen in FIG. 2A.

The side wings 15 of the pot-holding blank 10 extend essentially along a vertical plane XZ that comprises the longitudinal direction and the vertical direction of extension of the pots 4. The side wings 15 can have a vertical extension that is less than a vertical extension of the pots 4, for example between one-third and two-thirds of the vertical extension of the pots 4, in such a way that the pot-holding blank 10 surrounds only one end of the pots 4 and leaves the other end of the pots 4 free and visible. The side wings 15 of the pot-holding blank 10 can each in particular be continuous and in a single part. The side wings 15 can be articulated and made integral with the base 14 by grooved lines 26 that respectively extend in the longitudinal direction X and that form the transverse edges of the base 14.

The side wings 20 of the pot-unlocking blank 11 can have dimensions and orientations that are similar to those of the side wings 15 of the pot-holding blank 10.

The side wings of the pot-unlocking blank and the side wings of the pot-holding blank can have, for example, a vertical extension on the order of 40 to 50 millimeters. The base 14 of the pot-holding blank 10 and the base of the pot-unlocking blank 11 can have an extension in the transverse direction Y on the order of 60 to 100 millimeters and an extension in the longitudinal direction of 300 to 600 millimeters in length, making it possible, for example, to receive five to six pots.

In a general way, the pot-unlocking blank 11 and the pot-holding blank 10 have similar general dimensions, origination and configuration, in such a way that the sizing and orientation disclosed for the pot-holding blank 10 can also be applied to the pot-unlocking blank 11, unless expressly mentioned.

The side wings 15 comprise a large number of centering lunules 16. The centering lunules 16 are recesses in the side wings 15 that are suitable for being penetrated by portions of the collars 8 of the pots 4 of the row of individual pots 3.

The extension in the transverse direction Y of the base 14 can in particular be strictly less than the space requirement of the collar 8 of the pots 4 in said transverse direction Y, in such a way that the collars of the pots 4 penetrate over a certain distance through the centering lunules 16.

The centering lunules 16 can have an extension, in the longitudinal direction X, which is suitable for the leading edges 8*c* of the collars 8 of the pots 4 to be close to the edges 16*a* of the centering lunules. In this manner, the movement of the pots 4 in the longitudinal direction X and the transverse direction Y can be limited to the small spacing between the leading edge 8*c* of the collar 8 and the edge 16*a* of the corresponding centering lunule 16. With the cooperation of the gripping surfaces 12 and gripping counter-surfaces 13 further carrying out, when the unlocking assembly 11 is in the pot-holding position, holding and immobilization in the vertical direction Z, the movement of the pots 4 can be limited or blocked in the three directions of the space. Handling the row of pots 4 is therefore possible in an easy manner simply by handling the pot-holding system 2.

As can be seen in FIG. 2C, the gripping surfaces 12 are formed by, for example, gripping tabs 17 of the pot-holding blank 10, extending within the centering lunules 16, in particular in the vertical extension direction Z of the pots 4.

The gripping tabs 17 of the pot-holding blank 10 extend within the centering lunules 16 of the pot-holding blank 10, from the side wings 15 of the pot-holding blank 10 and in the direction of the base 14 of the pot-holding blank 10. Thus, if the side wings 15 of the pot-holding blank 10 extend toward the bottom from the base 14 of the pot-holding blank 10, the gripping tabs 17 can extend toward the top and vice versa.

The gripping surfaces 12 can in particular be formed by end edges 17*a* of said gripping tabs 17 as is illustrated in FIG. 2C. Thus, the gripping tabs 17 can be supported on their end edges 17*a* with a surface 8*a*, 8*b* of the collars 8 of pots 4.

The gripping surfaces 12 can thus have a width on the order of the thickness of the blank, for example several millimeters, and a length that is several times greater, by about 10 or 20 millimeters, for example, or a surface of about 100 square millimeters, for example.

The gripping counter-surfaces 13 can have a larger surface than the gripping surfaces 12, being formed in the base 14 of the blank 10, for example a surface of several square centimeters, at least 4 square centimeters. The gripping counter-surfaces 13 cannot be delimited and separated from one another on the base 14 of the pot-holding blank 10 but simply each defined by the shape of one end of the pot 4 that is adjacent to the base 14. The gripping counter-surfaces 13 can thus be connected to one another and form a solution to provide continuity on the base 14.

Furthermore, it is understood that the gripping surfaces 12 are in close contact with the collars 8 of the pots 4. The gripping surfaces of the pot-holding blank are in particular in contact with surfaces 8*a*, 8*b* of the collars 8 that are opposite to the end of each pot 4 that is surrounded by the U-shaped cross-section of the pot-holding blank 10. The gripping counter-surfaces 13 then exert a counter-support on the end 4*a*, 4*b* of each pot 4 that is surrounded by the U-shaped cross-section of the pot-holding blank 10.

Thus, in the example of FIG. 2A, the upper end 4*a* of each pot 4 of the row 3 of pots is surrounded by the U-shaped cross-section of the pot-holding blank 10, and the gripping surfaces of the pot-holding blank are then in contact with lower surfaces 8*b* of the collars 8 while the gripping counter-surfaces 13 exert a counter-support on the upper end 4*a* of each pot 4.

Figure 5:
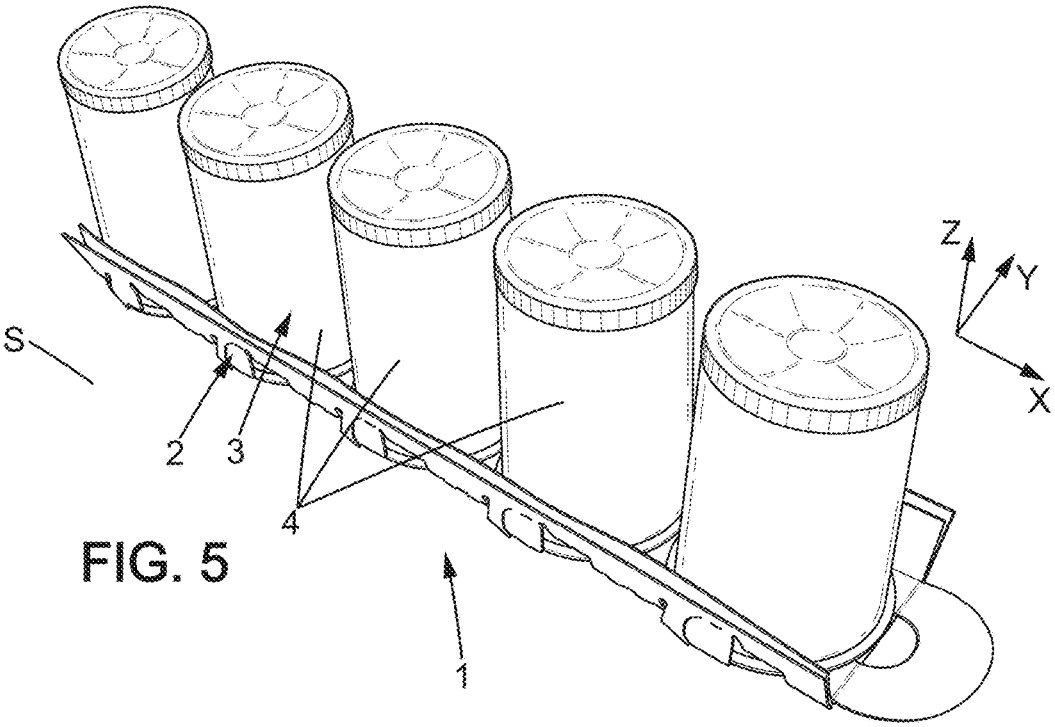
FIG. 5 is a top perspective view of a variant of a packaging of pots in accordance with the invention, in which the collar of the pots is placed opposite the opening, and, if necessary, the pot-holding system is left between the pots and the support after the pots are released so as to leave the pots available to be picked up by a consumer.

In the example of FIG. 5, the lower end 4*b* of each pot 4 of the row 3 of pots is surrounded by the U-shaped cross-section of the pot-holding blank 10, and the gripping surfaces of the pot-holding blank are then in contact with the upper surfaces 8*a* of the collars 8 while the gripping counter-surfaces 13 exert a counter-support on the lower end 4*b* of each pot 4.

In the examples of FIGS. 2A to 2C, the pot-unlocking assembly 11 is in the pot-holding position.

As has been seen, in the pot-holding position, the pot-unlocking assembly 11 leaves a large number of gripping surfaces and a large number of gripping counter-surfaces free to sandwich and to hold the pots of the row of individual pots. It is then possible for an operator to handle the row of individual pots easily by means of the pot-holding system 2, in which the pots 4 are held firmly.

Reference is now also made to FIGS. 3A to 3C, which illustrate the pot-unlocking assembly 11, this time in the unlocking position.

In the unlocking position, the pot-unlocking assembly 11 detaches from pots 4 at least one from among a large number of gripping surfaces 12 and a large number of gripping counter-surfaces 13. In this manner, the pots 4 of the row 3 of individual pots are released from the pot-holding assembly 10. In particular, the pot-unlocking assembly 11 can detach a large number of gripping surfaces 12 from the pots 4 as illustrated in FIG. 3C.

For this purpose, the pot-unlocking assembly 11 comprises a large number of unlocking surfaces 18 that are illustrated in particular in FIG. 3B.

The unlocking surfaces 18 are respectively associated with the gripping surfaces 12.

The phrase "unlocking surfaces are respectively associated with gripping surfaces" is defined as that at least one unlocking surface is associated with each gripping surface.

In the position for unlocking the pot-unlocking assembly 11, the unlocking surfaces 18 are inserted between the collars 8 of the pots 4 and the gripping surfaces 12. The pots 4 of the row 3 of individual pots are thus released from the pot-holding assembly 10 and can be picked up or the pot-holding system 2 can be removed from the row of individual pots.

The pot-unlocking assembly 11 can interact with, for example, the pot-holding assembly 12 in the following manner.

A pot-unlocking blank 11 of the pot-unlocking assembly 11 can be expanded in volume in such a way as to have, perpendicularly to the longitudinal direction, a U-shaped cross-section that is suitable for surrounding one end of each pot 4 of the row 3 of individual pots. The U-shaped cross-section of the pot-unlocking blank 11 can in particular surround the end of each pot 4 at or near the location from which the collar 8 extends.

Thus, the pot-unlocking blank 11 can comprise a base 19 and two side wings 20. The base 19 can extend along a horizontal plane XY, perpendicular to the vertical extension direction Z of the pots 4. The side wings 20 can be placed on either side of the base in a transverse direction Y of the horizontal plane XY, perpendicular to the longitudinal direction X. The side wings 20 can be inclined in relation to the base 19, in particular extend in the vertical direction Z, essentially perpendicular to said base 19 as can be seen in FIG. 2C.

The pot-holding blank 10 and the pot-unlocking blank 11 can thus have shapes in volume that are essentially similar, so that they can be stacked one on top of another.

The pot-unlocking blank 11 can thus be sandwiched between the pot-holding blank 10 and the pots 4 of the row 3 of individual pots as illustrated in FIG. 2C.

The base 19 of the pot-unlocking blank 11 then comes into contact with the end of each pot of the row of individual pots that is surrounded by the U-shaped cross-section of the pot-unlocking blank 11. The base 19 of the pot-unlocking blank 11 can furthermore be in contact with the base 14 of the pot-holding blank 10.

Thus, the gripping counter-surfaces 13 of the pot-holding assembly 10 can exert a counter-support on the ends 4*a* of the pots 4 of the row 3 of pots by means of the base 19 of the pot-unlocking blank 11.

The unlocking surfaces 18 can be formed in the side wings 20 of the pot-unlocking blank 11 as illustrated in FIG. 2A.

For this purpose, the side wings 20 of the pot-unlocking blank 11 comprise, for example, a large number of openings 21. The side wings 20 also comprise a large number of unlocking tabs 22, each extending within an opening 21, for example in the vertical extension direction Z of the pots 4, in particular toward the top.

The openings 21 of the side wings 20 of the pot-unlocking blank 11 are penetrated by portions of the collars 8 of the pots 4 of the row of individual pots.

The unlocking surfaces 18 are then formed on the unlocking tabs 22 of the pot-unlocking blank 11. The unlocking surfaces 18 can be formed by, for example, extension surfaces 22*b* of said unlocking tabs 22 that are directed toward the outside of the U-shaped cross-section of the pot-unlocking blank 11.

The unlocking tabs 22 of the pot-unlocking blank 11 can in particular extend, within openings 21 of the pot-unlocking blank 11, from the side wings 20 of the pot-unlocking blank 11 and in the direction of the base 19 of the pot-unlocking blank 11. Thus, if the side wings 20 of the pot-unlocking blank 11 extend toward the bottom from the base 19 of the pot-unlocking blank 11, the unlocking tabs 22 can extend toward the top and vice-versa.

The unlocking tabs 22 can be respectively associated with gripping tabs 17. "Respectively associated" means that at least one unlocking tab is associated with each gripping tab.

More specifically, the pot-holding blank 10 can comprise, for each individual pot 4 of the row of pots, two centering lunules 16, made respectively in each of the side wings 15 of the pot-holding blank 10, and two gripping tabs 17, also formed respectively in each of the side wings 15 of the pot-holding blank 10. In a similar manner, the pot-unlocking blank 11 can comprise, for each individual pot 4 of the row of pots, two openings 21, made respectively in each of the side wings 20 of the pot-unlocking blank 11, and two unlocking tabs 22, also formed respectively in each of the side wings 20 of the pot-unlocking blank 11.

The openings 21 and centering lunules 16 that are associated with each individual pot 4 of the row of pots can receive portions of the collar 8 of said pot 4 that are opposite in the transverse direction Y that is perpendicular to the longitudinal direction X. The gripping tabs 17 that are associated with said pot 4 can also come on either side of said pot 8 in the transverse direction Y.

As will be seen, the openings 21 can have an extension that is greater than an extension of the centering lunules 16 in the longitudinal direction X, in such a way as to allow a movement of the unlocking blank 11 between the pot-holding position and the pot-unlocking position. Thus, for example, if the unlocking blank moves over a distance D in the longitudinal direction X between the pot-holding position and the pot-unlocking position, the openings 21 can have an extension that is larger at least from said distance D to the extension of the centering lunules 16 in the longitudinal direction X.

The passage of the pot-unlocking assembly 11 from the pot-holding position to the pot-unlocking position is done in the following manner.

As can be seen in FIG. 2A, when the pot-unlocking blank 11 is in the pot-holding position, the unlocking tabs 22 of the pot-unlocking blank 11 extend through the centering lunules 16 of the pot-holding blank 10 and near the gripping tabs 17 of the pot-holding blank 10.

And, when the pot-unlocking blank 11 comes into the unlocking position, the unlocking tabs 22 are inserted between the gripping tabs 17 and the collars 8 of the pots 4 of the row 3 of individual pots.

For this purpose, each unlocking tab 22 has a side leading edge 22*a* while the gripping tab 17 that is associated with said unlocking tab 22 has a side edge 17*b* that is opposite to the side leading edge 22*a*.

"A side edge opposite the side leading edge" means that when the pot-holding system 2 is in the pot-holding position, the side edge faces said side leading edge. Thus, if the side leading edge is a straight edge of an unlocking tab (with the term "straight" being defined in relation to the longitudinal direction), the side edge will then be a left edge of the gripping tab (with the term "left" being defined as the direction opposite to the same longitudinal direction) and vice versa.

The side edge 17*b* of the gripping tab 17 can in particular end at the location of the gripping surface 12*a*, in particular when said gripping surface 12 is formed by an end edge 17*a* of the gripping tab 17.

The side leading edge 22*a* of the unlocking tab 22 extends beyond the side edge 17*b* of the associated gripping tab 17.

"Extends beyond" is defined as that, according to the extension direction of the unlocking and gripping tabs, the side leading edge of the unlocking tab goes beyond the side edge of the gripping tab. For example, if the extension direction of the unlocking and gripping tabs is the vertical direction Z, in particular toward the top in the vertical direction Z, the side leading edge of the unlocking tab can extend higher than the side edge of the gripping tab.

In this manner, when the pot-unlocking assembly 11 is in the pot-holding position that is illustrated in FIG. 2A, the gripping surfaces 12 formed on the end edges 17*a* of the gripping tabs 17 can be in contact with the surfaces 8*b* of the collars 8 of the pots and, when the pot-unlocking assembly is in the unlocking position that is illustrated in FIG. 3A, the unlocking tabs 22 can come into contact with leading edges 8*c* of the collars 8 of the pots 4 and can be inserted between the gripping tabs 17 and the collars 8 of the pots 4.

To facilitate the movement of the unlocking assembly, when the pot-unlocking assembly 11 is in the pot-holding position, the unlocking tabs 22 of the pot-unlocking blank can be arranged at least in part between the leading edges 8*c* of the collars of the pots and the gripping tabs 17.

As illustrated in FIG. 3A, the movement between the holding position and the unlocking position of the pot-unlocking blank 11 can be carried out by a sliding in the longitudinal direction X in relation to the pot-holding blank 10.

Additionally, the side leading edges 22*a* of the unlocking surfaces 22 can be inclined in relation to the side edges 17*b* with regard to the gripping tabs 17 that are associated with each unlocking tab 22. The side leading edges 22*a* of the unlocking surfaces 22 can more precisely be inclined in relation to a vertical direction Z that is perpendicular to the longitudinal direction X for movement of the pot-unlocking blank 11 in relation to the pot-holding blank 10.

In this manner, the unlocking tabs are able to be inserted gradually between the gripping tabs and the collars of the pots of the row of individual pots when the pot-unlocking assembly is moved from the pot-holding position to the unlocking position.

The pot-unlocking blank 11 can also comprise at least one stopping tab 23. The stopping tab 23 can extend from the base 19 of the pot-unlocking blank 11, through at least one opening 21 of the pot-unlocking blank 19 and through at least one centering lunule 16 of the pot-holding blank 10.

The stopping tab 23 is suitable for abutting against an edge 16*a* of said centering lunule 16 of the pot-holding blank 10. In this manner, it is possible to limit the movement of the pot-unlocking blank in relation to the pot-holding blank between the holding position and the unlocking position.

Finally, one among the pot-holding blank 10 and the pot-unlocking blank 11 can comprise a traction tab 24 that is illustrated in FIG. 3A, placed at a longitudinal end of said blank. In the example of FIG. 3A, the pot-unlocking blank 11 has said traction tab 24.

The traction tab 24 makes it possible to slide the pot-holding blank 10 and the pot-unlocking blank 11 easily with respect to one another in such a way as to move the pot-unlocking assembly between the holding position and the unlocking position.

The traction tab 24 can in particular have a central opening 24*a* that makes it possible to provide access to the collars 8 of pots of the row of individual pots that are sandwiched and held by the pot-holding blank 10. The central opening 24*a* can have, for example, the width of a human finger in the transverse direction. It thus is possible for an operator moving the pot-unlocking blank in relation to the pot-holding blank to hold the pots 4 manually during this operation by inserting a finger into the central opening 24*a* of the traction tab 24.

FIG. 2A thus illustrates a packaging of a row 3 of individual pots that comprise a pot-holding system 2, as described above, and a row 3 of individual pots 4, with the pots 4 being sandwiched and held between the gripping surfaces 12 and the gripping counter-surfaces 13 of the pot-holding assembly 10.

To release the individual pots from such a packaging 1, an operator can thus:

- Place the packaging of the individual pots 1 on a support S, for example a supermarket display stand,
- Hold the pot-holding assembly 10 and/or the pots 4, for example by inserting a finger into the central opening 24*a* of the traction tab 24,
- Exert a force on the unlocking assembly 11 in such a way as to move the pot-unlocking assembly 11 in relation to the pot-holding assembly 10 from the holding position to the unlocking position, for example by exerting a force on the traction tab 24.

In a first embodiment of the invention, illustrated in FIG. 2A, the packaging 1 of individual pots is placed on a support S in such a way that the pots 4 of the row 3 rest on the support S at one end 4*b* of the pots opposite to the collar 3, in particular in the case where the collar is placed close to the opening 4*c* of the pots 4.

Figure 4:
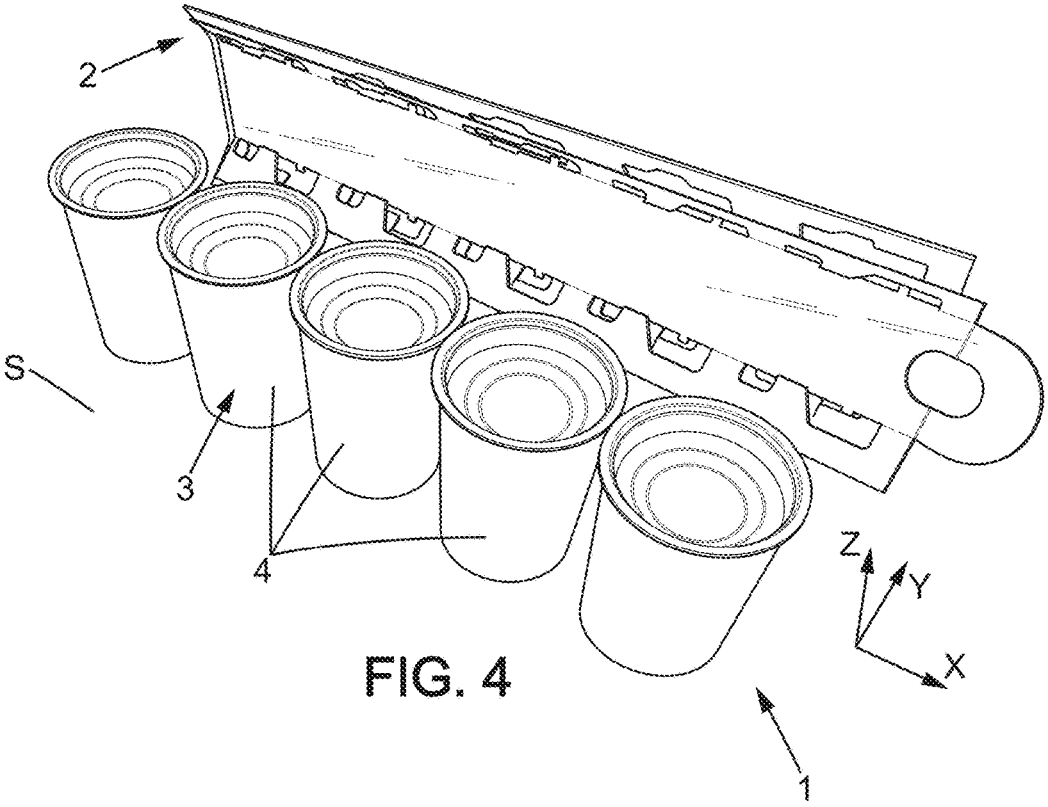
FIG. 4 is a top perspective view of a final step of a method for releasing individual pots from a packaging of pots in accordance with the invention in which the pot-holding system is removed after pots are released to leave the pots available to be picked up by a consumer.

In this embodiment, it is then possible to remove in addition the holding system 2 of the packaging 1 by allowing the pots 4 to rest on the support S as illustrated in FIG. 4. The pots 4 are then available to be picked up by a consumer.

In a second embodiment that is illustrated in FIG. 5, the packaging 1 is placed on a support S in such a way that the pots 4 of the row 3 rest on the support S by means of the pot-holding system 2 at one end 4*b* of the pots that have the collar 3, for example in the case where the collar 8 is placed opposite the opening 4*c* of the pots 4.

In this embodiment, it is then possible to leave the holding system 2 between the pots 4 and the support S after implementing the releasing process. The pots 4 then rest on the unlocked pot-holding system 2 and are also available to be picked up by a consumer.

It is noted that the movement of the pot-holding assembly 10 from the holding position to the unlocking position is done in one direction. That is to say, it is preferable to flatten the pot-holding blank if it is desired to reconstruct the system in the holding position.

By now referring to FIGS. 6A to 6C and 2A, a pot-holding system 2 according to the invention as illustrated in FIG. 2A can be carried out starting from a flat blanks kit 25 as illustrated.

Such a kit 25 comprises a flat pot-holding blank 10 and a flat pot-unlocking blank 11.

"Flat" in the expression "flat blank" is defined as that the blank is deployed in such a way as to be found at least essentially in one and the same plane P. Unless stated otherwise, the term "blank," without further details, should be understood as pertaining to the blank in volume as described above, in contrast to the flat blank.

The flat pot-holding blank 10 and the flat pot-unlocking blank 11 respectively have a general rectangular shape that extends essentially in a longitudinal direction X and to a lesser extent in a transverse direction Y that is perpendicular to the longitudinal direction.

The pot-holding blank 10 and the pot-unlocking blank 11 are respectively limited by two free edges in the longitudinal direction and two free edges in the transverse direction. In the embodiment shown, the free edges are straight, but in other embodiments, they may not be, being, for example, scalloped. The pot-holding blank 10 and the pot-unlocking blank 11 are symmetrical or essentially symmetrical in relation to a longitudinal median axis.

The pot-holding blank 10 and the pot-unlocking blank 11 are made of cardboard or the like as indicated above.

The flat pot-holding blank 10 comprises a base panel 14 that is respectively surrounded on either side, in the transverse direction Y, by two respective side wing panels 15. The base panel 14 and the respective side wing panels 15 an essentially rectangular shape.

"Panel" is defined as a flat part in the form of a layer, made of cardboard in this case, delimited by an edging that comprises grooved lines and/or cut-out lines.

The base panel 14 is separated from the side wing panels 15 by grooved lines 26 or cut-out lines that extend in the longitudinal direction X over all, or a majority of, the longitudinal extension of the base panel 14 and that form the transverse edges of said base panel 14, otherwise delimited at the longitudinal ends by the free edges of the pot-holding blank 10. The lines 26 allow the folding of the side wing panels 15 in relation to the base panel 14 in such a way as to form a pot-holding blank 10 in volume that has a U-shaped cross-section that is perpendicular to the longitudinal direction X as illustrated in FIG. 2A.

The base panel 14 of the flat pot-holding blank 10 corresponds to the base 14 of the pot-holding blank 10 in volume. The single reference 14 is therefore given to these elements. Likewise, the side wing panels 15 of the flat pot-holding blank 10 correspond to the side wings 15 of the pot-holding blank 10 in volume. The single reference 15 is therefore given to these elements. The base panel 14 and the base 14 are identical other than their position in space with respect to the side wing panels 15 and side wings 15. Likewise, the side wing panels 15 and the side wings 15 are identical other than their position in space with respect to the base panel 14 and base 14.

The side wing panels 15 of the pot-holding blank comprise a large number of centering lunules 16 and a large number of gripping tabs 17 that extend within the centering lunules 16.

The pot-unlocking blank 11 also comprises a base panel 19 that is respectively surrounded on either side, in the transverse direction Y, by two respective side wing panels 20. The base panel 19 and the side wing panels 20 have an essentially rectangular shape.

The base panel 19 of the pot-unlocking blank 11 is separated from the side wing panels 20 by grooved lines 27 or cut-out lines that extend in the longitudinal direction X over all, or a majority, of the longitudinal extension of the base panel 19 and that form the transverse edges of said base panel 19, otherwise delimited on longitudinal ends by the free edges of the pot-unlocking blank 11. The lines 26 make it possible to fold the side wing panels 20 in relation to the base panel 19 in such a way as to form a pot-unlocking blank 11 in volume that has a U-shaped cross-section that is perpendicular to the longitudinal direction X as illustrated in FIG. 2A.

The side wing panels 20 of the pot-unlocking blank 11 comprise a large number of openings 21 and a large number of unlocking tabs 22 that extend within the openings 21.

The flat pot-unlocking blank 11 can also comprise at least one stopping tab 23. The stopping tab 23 extends from the base panel 19 of the pot-unlocking blank 11 and through at least one opening 21 of the pot-unlocking blank 11.

"Extends from the base panel and through at least one opening" is defined as said stopping tab going beyond, in the transverse direction, the base panel that is otherwise of essentially rectangular shape.

As indicated above relative to the pot-holding blank 10, the base panel 19 of the flat pot-unlocking blank 11 corresponds to the base 19 of the pot-unlocking blank 11 in volume. The single reference 19 is therefore given to these elements. Likewise, the side wing panels 20 of the flat pot-unlocking blank 11 correspond to the side wings 20 of the pot-unlocking blank 11 in volume. The single reference 20 is therefore given to these elements. The base panel 19 and the base 19 are identical other than their position in space with respect to the side wing panels 20 and side wings 20. Likewise, the side wing panels 20 and the side wings 20 are identical other than their position in space with respect to the base panel 19 and base 19.

The gripping tabs 17 and the unlocking tabs 22 extend in the transverse direction Y. The gripping tabs 17 and the unlocking tabs 22 have, for example, a shape that is essentially rectangular or trapezoidal.

The gripping tabs 17 can be defined in the side wing panels 15 of the pot-holding blank 10 by grooved lines 28, in particular defined by the cut-out lines except for a grooved line 28 for each gripping tab 17, in such a way as to be able to be folded in relation to said side wing panels 15. The grooved lines 28 can extend in the longitudinal direction X, in such a way as to make possible a pivoting of the gripping tabs 17 around the longitudinal axis X as can be seen in FIG. 3C. In this manner, it is possible to detach the gripping surfaces 12 easily from the collars 8 of the pots 4 during the passage of the unlocking assembly 11 from the pot-holding position to the unlocking position.

Conversely, the unlocking tabs 22 can be rigidly formed in the side wing panels 20 of the pot-unlocking blank 11, i.e., be delimited in said blanks without grooved lines. In this manner, the unlocking tabs 22 are able to exert more force on the gripping tabs 17 to detach the gripping surfaces 12 of the collars 8 of the pots 4 during the passage of the unlocking assembly 11 from the pot-holding position to the unlocking position.

The unlocking tabs 22 of the flat pot-unlocking blank 11 are at least in part defined by cut-out lines 29 that penetrate into the base panel 19 of the pot-unlocking blank 11.

"Cut-out lines that penetrate into the base panel" are defined as said cut-out lines that form an indentation that bites into said base panel that is otherwise essentially rectangular in shape.

In this manner, when the pot-unlocking blank 11 is formed in volume and has a U-shaped cross-section that is perpendicular to the longitudinal direction X, the unlocking tabs 22 are extended, into the openings 21 of the pot-unlocking blank 11, beyond the base 19 of the pot-unlocking blank 11.

The centering lunules 16 and the openings 21 have, for example, a general shape of a rectangle, rounded rectangle, or half-moon. Thus, for example, a straight edge of the openings 21 can be formed by a cut-out line that delimits a base panel 19 of the pot-unlocking blank 11 and a cut-out line that penetrates into a side wing panel 20 of the pot-unlocking blank 11, otherwise essentially rectangular. The centering lunules 16 can be formed by a cut-out line that penetrates into a base panel 14 of the pot-holding blank 10 and a cut-out line that penetrates into a side wing panel 15 of the pot-holding blank 10.

The cut-out lines, respectively centering lunules 16 and openings 21, penetrate into a side wing panel that can in particular be interrupted, respectively, by a gripping tab 17 and an unlocking tab 22.

The blanks 10, 11 of the blank kit 25 can be produced by cutting out and scoring cardboard plates according to known means, furthermore. The cut-out lines indicated above are formed by using a cutting tool. The grooved lines indicated above are also well known in the field of packaging and cardboard and make it possible to fold in a relative way two adjacent panels in a predefined location. Such grooved lines are formed by using a scoring tool. It is understood that the expression "grooved line" should be understood in the broadest way as meaning that the line is suitable and intended for the relative folding of two adjacent panels.

The blanks 10, 11 of the blank kit 25 can be used to produce a packaging 1 as described above in the following manner.

Figure 6A:
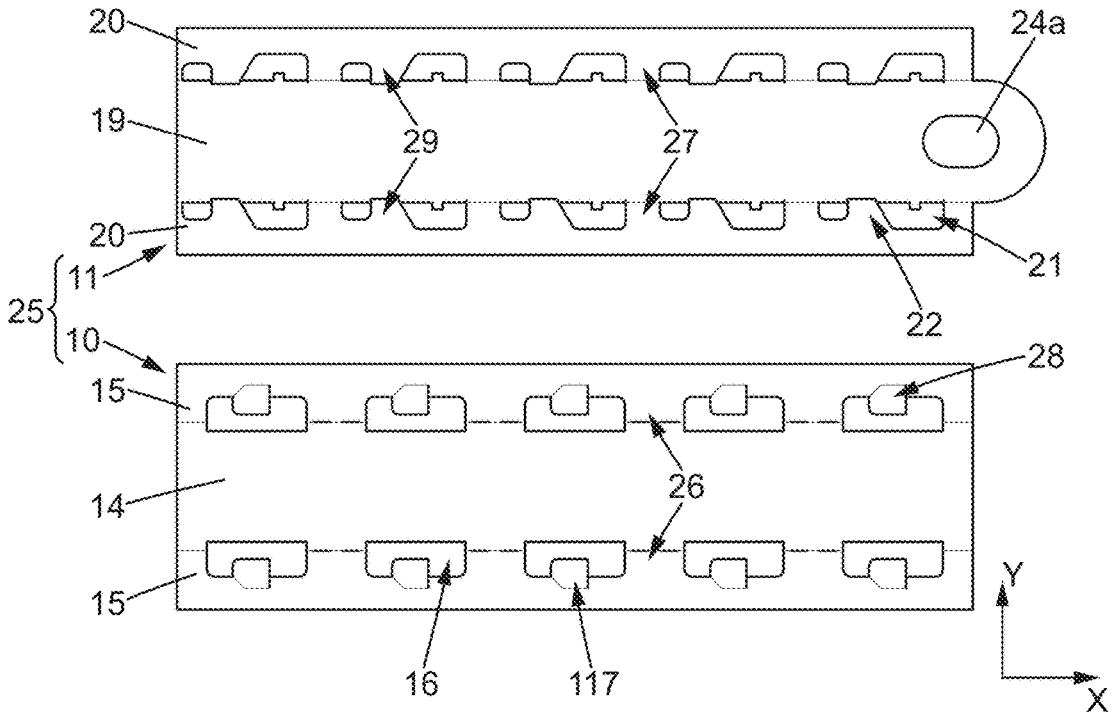
FIGS. 6A to 6C are three diagrams that illustrate the method for production of a packaging of pots such as the one of FIG. 2A, namely a top view, of a blank kit in accordance with the invention making it possible to produce a pot-holding system and to carry out a packaging of pots according to the invention in FIG. 6A, the arrangement and the alignment of the pots for forming a row in FIG. 6B, and the stacking of the pot-holding blank, pot-unlocking blank, and individual pots in FIG. 6C.
Figure 6B:
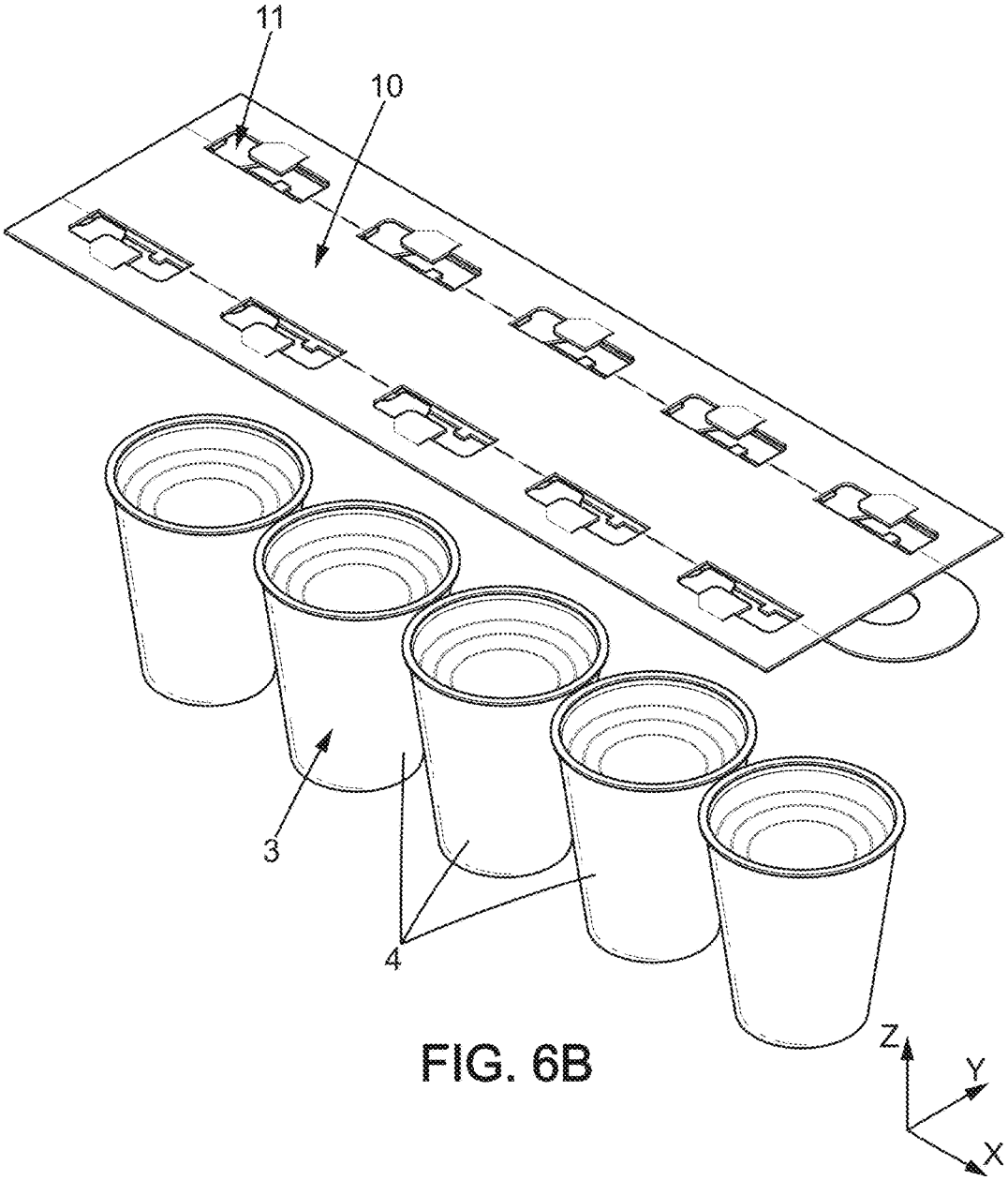
Figure 6C:
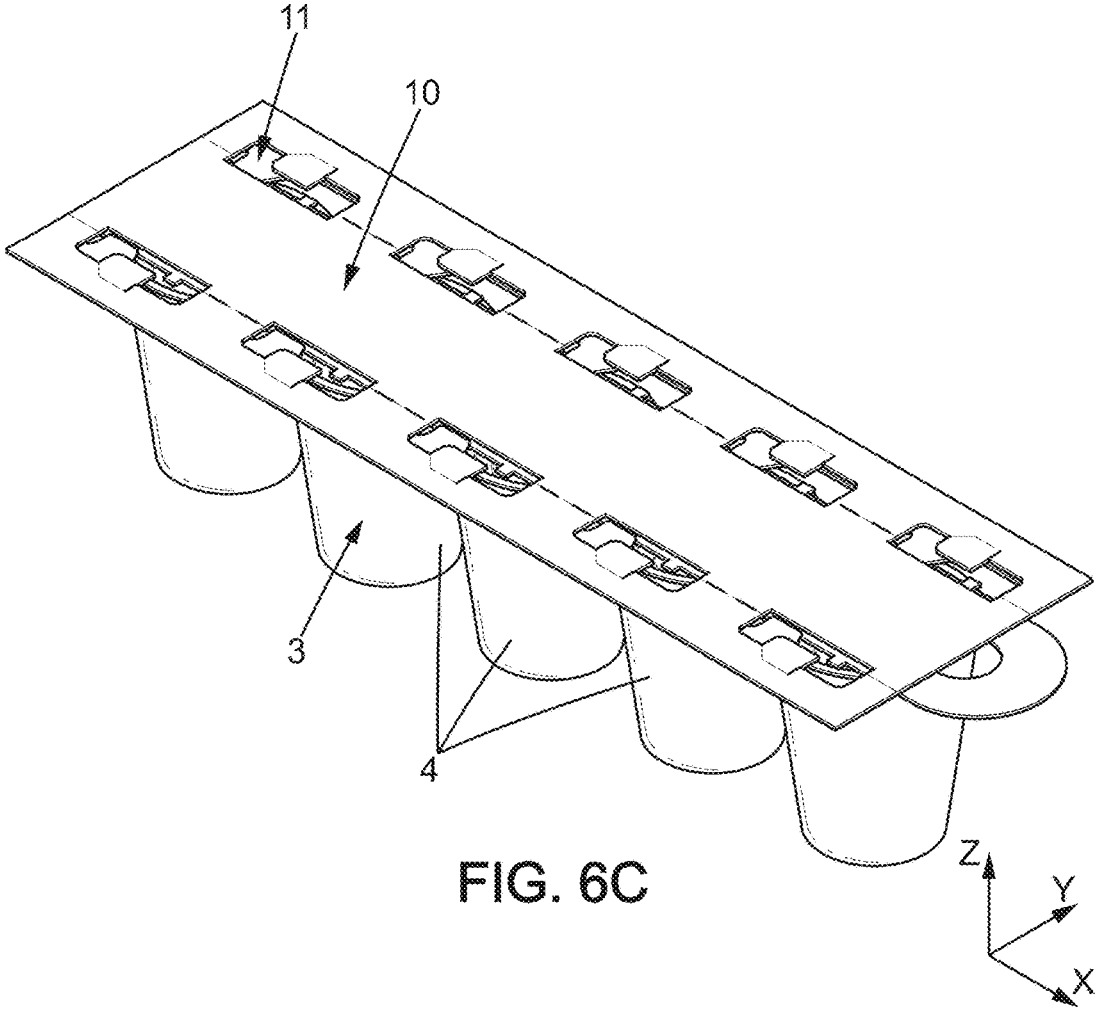

Thus, having available a flat blanks kit 25 as well as individual pots 4 as described above, the pots 4 are first aligned in a longitudinal direction X for forming a row 3 as illustrated in FIG. 6B.

In a first embodiment of the invention, the pots 4, the flat pot-holding blank 10, and the flat pot-unlocking blank 11 are then stacked in such a way that the pot-unlocking blank 11 is sandwiched between the pot-holding blank 10 and the pots 4.

In a second embodiment of the invention, the flat pot-holding blank 10 and the flat pot-unlocking blank 11 are first stacked with one another, and then the individual pots 4 are arranged on the flat pot-unlocking blank 11, and the pots are aligned in the longitudinal direction X for forming a row 3 of individual pots.

In these two embodiments, the side wing panels 15 of the flat pot-holding blank 10 are then folded in relation to the base panel 14 of the flat pot-holding blank around grooved lines 26. Also, if necessary simultaneously, the side wing panels 20 of the flat pot-unlocking blank 11 are folded in relation to the base panel 19 of the flat pot-unlocking blank 11 around the grooved lines 27.

Thus, there are formed a pot-holding blank 10 in volume and a pot-unlocking blank 11 in volume, each having, perpendicularly to the longitudinal direction X, a U-shaped cross-section that surrounds the upper end 4*a* of each pot 4 of the row 3.

When the side wing panels 15 of the flat pot-holding blank 10 are folded in relation to the base panel 14 of the flat pot-holding blank, the gripping tabs 17 are brought into contact with the collars 8 of the pots 4, for example in contact with the lower surface 8*b* of the collars 8, and the base panel 14 of the pot-holding blank 10 is placed resting against the pots 4, for example resting with the upper end 4*a* of the pots 4, in particular by means of the base panel 19 of the pot-unlocking blank 11.

The pots 4 are thus sandwiched and held between the gripping surfaces 12 and the gripping counter-surfaces 13 of the pot-holding blank 10 in volume.

To ensure the good positioning of the pots, pot-holding blank 10, and pot-unlocking blank 11, when the pots 4, the flat pot-holding blank 10, and the flat pot-unlocking blank 11 are stacked, it is possible in particular to align, in the longitudinal direction X, the pots 4, the flat pot-holding blank 10, and the flat pot-unlocking blank 11 in such a way that the collars 8 of the individual pots are at least in part placed opposite in the transverse direction Y, centering lunules 16 of the flat pot-holding blank 10, and openings 21 of the flat pot-unlocking blank 11.

In the longitudinal direction X, it is also possible to align the pots 4, the flat pot-holding blank 10, and the flat pot-unlocking blank 11 in such a way that the collars 8 of the pots 4 are at least in part placed opposite the gripping tabs 17 of the flat and offset pot-holding blank 10, in the longitudinal direction X, in relation to the unlocking tabs 18.

In this manner, when the flat pot-holding blank 10 and the pot-unlocking blank 11 are expanded in volume, the pot-holding system 2 is obtained with the unlocking assembly 11 in the pot-holding position.

The invention also relates to a production line for a packaging 1 as has been described.

Such a line comprises means for making available kits 25 of flat blanks 10, 11. It also comprises means for making available individual pots 4, intended to be part of the row 3.

Such a line also comprises, associated with means for making kits 25 available and means for making the following available: pots 4, conveying means, capable of and intended for conveying blanks of flat blanks kits, individual pots, stacked pots and blanks, and packages of individual pots, with, ultimately, functional means.

These functional means comprise, from upstream to downstream, firstly, movement grasping means, and arrangement of individual pots and flat blanks, capable of and intended for aligning individual pots in a longitudinal direction for forming rows of individual pots, and in stacking the individual pots, the flat pot-holding blanks, and the flat pot-unlocking blanks, on the conveying means, in such a way that each pot-unlocking blank is sandwiched between a flat pot-holding blank and individual pots of a row of individual pots.

These functional means comprise, secondly, folding means, capable of and intended for expanding in volume the pot-holding blanks 10 and the pot-unlocking blanks 11 for having, perpendicularly to the longitudinal direction X, a U-shaped cross-section surrounding one end 4*a* of each pot 4 of the row 3 of individual pots. The pots are thus sandwiched and held between the gripping surfaces 12 and the gripping counter-surfaces 13 of the pot-holding blanks 10, by folding, around the grooved lines 26, side wing panels 15 in relation to the base panel 14 of the flat pot-holding blank 10 and side wing panels 20 in relation to the base panel 19 of the flat pot-unlocking blank 11.

These functional means comprise, finally, means for removing packages from individual pots.

The invention claimed is:

1. A system for holding a row of individual pots, said system being configured to facilitate shelving of a row of individual pots that are aligned in a longitudinal direction, the pots having a bottom wall, a side wall that is closed on itself, and a collar at one end of the pot, the system comprising:

a pot-holding assembly that extends in a longitudinal direction, the pot-holding assembly comprising a pot-holding blank with a plurality of gripping surfaces that are configured to exert a support on the collars of the pots of the row of individual pots, a plurality of gripping counter-surfaces that are configured to exert a counter-support on the pots of the row of individual pots such that said pots are sandwiched and held between the gripping surfaces and the gripping counter-surfaces of the pot-holding assembly; and a pot-unlocking assembly comprising a pot-unlocking blank, the pot-unlocking assembly being configured to be moved in relation to the pot-holding assembly between a pot-holding position in which the pot-unlocking assembly leaves a plurality of gripping surfaces and a plurality of gripping counter-surfaces free to sandwich and to hold the pots of the row of individual pots, and an unlocking position in which the pot-unlocking assembly detaches from the pots at least one among a plurality of the gripping surfaces and a plurality of the gripping counter-surfaces, to release the pots from the row of individual pots of the pot-holding assembly, wherein the pot-unlocking blank is configured to move in relation to the pot-holding blank between the holding position and the unlocking position by a sliding in the longitudinal direction.

2. The system according to claim 1, wherein the pot-holding blank has, perpendicularly to the longitudinal direction, a U-shaped cross-section that is configured to surround one end of each pot of the row of individual pots, the pot-holding blank comprising a base and two side wings on either side of the base that are inclined in relation to said base.

3. The system according to claim 2, wherein the gripping surfaces are formed in the side wings of the pot-holding blank, and the gripping counter-surfaces are formed in the base of the pot-holding blank.

4. The system according to claim 2, wherein the side wings of the pot-holding blank comprise a plurality of centering lunules configured to be penetrated by portions of the collars of the pots of the row of individual pots, and wherein the gripping surfaces are formed on gripping tabs of the pot-holding blank that extend within the centering lunules.

5. The system according to claim 2, wherein, when the pot-unlocking assembly is in the pot-holding position, the gripping counter-surfaces of the pot-holding assembly are configured to exert a counter-support on the end of each pot of the row of individual pots that is surrounded by the U-shaped cross-section of the pot-holding blank.

6. The system according to claim 2, wherein the base of the pot-unlocking blank is configured to come into contact with the end of each pot of the row of individual pots that is surrounded by the pot-unlocking blank, the unlocking surfaces being formed in the side wings of the pot-unlocking blank.

7. The system according to claim 2, wherein, when the pot-unlocking assembly is in the pot-holding position, the gripping counter-surfaces of the pot-holding assembly are configured to exert a counter-support on the end of each pot of the row of individual pots that is surrounded by the U-shaped cross-section of the pot-holding blank by the base of the pot-unlocking blank, and wherein, when the pot-unlocking assembly is in the pot-holding position, the gripping counter-surfaces of the pot-holding assembly are in contact with the base of the pot-unlocking blank, and said base of the pot-unlocking blank is configured to be in contact with the end of each pot of the row of individual pots.

8. The system according to claim 2, wherein the side wings of the pot-unlocking blank comprise a plurality of openings that are configured to be penetrated by portions of the collars of the pots of the row of individual pots, and wherein unlocking surfaces are formed on unlocking tabs of the pot-unlocking blank that extend within the openings of the pot-unlocking blank, by extension surfaces of said tabs that are directed toward the outside of the U-shaped cross-section of the pot-unlocking blank.

9. The system according to claim 8, wherein when the pot-unlocking blank is in the pot-holding position, the unlocking tabs of the pot-unlocking blank extend through the centering lunules of the pot-holding blank, near the gripping tabs of the pot-holding blank, and when the pot-unlocking blank is in the unlocking position, the unlocking tabs are configured to be inserted between the gripping tabs and the collars of the pots of the row of individual pots.

10. The system according to claim 8, wherein each unlocking tab comprises a side leading edge that extends beyond a side edge opposite the gripping tab that is associated with the unlocking tab.

11. The system according to claim 8, wherein, when the pot-unlocking assembly is in the pot-holding position, the unlocking tabs of the pot-unlocking blank are disposed at least in part between leading edges of the collars of the pots and the gripping tabs.

12. The system according to claim 1, wherein when the pot-unlocking assembly is in the pot-holding position, the gripping surfaces of the pot-holding assembly are able to be in close contact with the collars of the pots.

13. The system according to claim 1, wherein the pot-unlocking assembly comprises a plurality of unlocking surfaces that are respectively associated with the gripping surfaces, the unlocking surfaces being configured to be inserted between the collars of the pots and the gripping surfaces when the pot-unlocking assembly is in the unlocking position, to release the pots from the row of individual pots of the pot-holding assembly.

14. The system according to claim 1, wherein the pot-unlocking blank is configured to be sandwiched between the pot-holding blank and the pots of the row of individual pots.

15. The system according to claim 1, wherein a side leading edge of an unlocking tab is inclined in relation to a vertical direction that is perpendicular to the longitudinal direction for movement of the pot-unlocking blank, such that said unlocking tab is configured to be inserted gradually between the gripping tab and the collars of pots of the row of individual pots when the pot-unlocking assembly is moved from the pot-holding position to the unlocking position.

16. The system according to claim 1, wherein the pot-unlocking blank comprises at least one stopping tab that extends from the base of the pot-unlocking blank, through at least one opening of the pot-unlocking blank, and through at least one centering lunule of the pot-holding blank, said at least one stopping tab configured to abut against an edge of at least one centering lunule of the pot-holding blank to limit a movement of the pot-unlocking assembly in relation to the pot-holding assembly between the holding position and the unlocking position.

17. The system according to claim 1, wherein the pot-unlocking assembly comprises a traction tab which enables a sliding motion of the pot-unlocking assembly in relation to the pot-holding assembly to move the pot-unlocking assembly between the holding position and the unlocking position.

18. The system according to claim 17, wherein the traction tab has a central opening that is configured to enable a manual holding of the pots by an operator and enable the manipulation of the pot-unlocking assembly in relation to the pot-holding assembly from the holding position to the unlocking position.

19. A packaging of a row of individual pots comprising:

the pot-holding system according to claim 1; and the row of individual pots, the pots having a bottom wall, a side wall that is closed on itself, and a collar at one end of the pot, the pots being aligned in a longitudinal direction to form the row of individual pots.

20. The packaging according to claim 19, wherein, when the pot-unlocking assembly is in the pot-holding position, the pots are sandwiched and held between the gripping surfaces and the gripping counter-surfaces of the pot-holding assembly.

21. The packaging according to claim 19, wherein, when the pot-unlocking assembly is in the pot-unlocking position, the pots are released from the pot-holding assembly.

* * * * *